US005875663A

United States Patent [19]

Tateno et al.

[11] Patent Number: 5,875,663

[45] Date of Patent: Mar. 2, 1999

[54] ROLLING METHOD AND ROLLING MILL OF STRIP FOR REDUCING EDGE DROP

[75] Inventors: Junichi Tateno; Kazuhito Kenmochi; Ikuo Yarita; Hisao Imai; Tomohiro Kaneko; Yasuhiro Yamada; Toshihiro Fukaya, all of Chiba, Japan

[73] Assignee: Kawasaki Steel Corporation, Kobe, Japan

[21] Appl. No.: 895,609

[22] Filed: Jul. 16, 1997

[30] Foreign Application Priority Data

| | | | |
|---|---|---|---|
| Jul. 18, 1996 | [JP] | Japan | 8-189115 |
| Jul. 18, 1996 | [JP] | Japan | 8-189116 |
| Jan. 19, 1997 | [JP] | Japan | 9-018876 |
| Feb. 19, 1997 | [JP] | Japan | 8-033508 |
| Feb. 19, 1997 | [JP] | Japan | 9-035198 |

[51] Int. Cl.[6] ..... B21B 37/68

[52] U.S. Cl. ..... 72/12.8; 72/9.2; 72/11.8; 72/241.4; 72/247

[58] Field of Search ..... 72/7.6, 8.3, 8.9, 72/9.2, 11.2, 11.6, 11.8, 12.7, 12.8, 241.2, 241.4, 241.8, 247, 365.2

[56] References Cited

U.S. PATENT DOCUMENTS

| | | | |
|---|---|---|---|
| 5,131,252 | 7/1992 | Turley et al. | 72/247 |
| 5,174,144 | 12/1992 | Kajiwara et al. | 72/247 |
| 5,231,858 | 8/1993 | Yamashita et al. | 72/247 |
| 5,524,465 | 6/1996 | Kajiwara et al. | 72/247 |

FOREIGN PATENT DOCUMENTS

| | | | |
|---|---|---|---|
| 0 276 743 A1 | 8/1988 | European Pat. Off. . | |
| 0 488 367 A1 | 6/1992 | European Pat. Off. . | |
| A-55-77903 | 6/1980 | Japan . | |
| A-57-206503 | 12/1982 | Japan . | |
| A-62-263802 | 11/1987 | Japan . | |
| A-63-264204 | 11/1988 | Japan . | |
| 4-344814 | 12/1992 | Japan | 72/241.8 |
| 5-285515 | 11/1993 | Japan | 72/11.2 |
| 6-142730 | 5/1994 | Japan | 72/229 |
| A-8-57515 | 3/1996 | Japan . | |

OTHER PUBLICATIONS

Kitamura, Kunio et al. "Edge–drop Control of Hot and Cold Rolled Strip by Tapered–crown Work Roll Shifting Mill." *Iron and Steel Engineer*. Feb. 1995, pp. 27–32.

Kamada, Shunji et al. "Edge Profile Control using Pair Cross Mill in Cold ROlling." *Iron and Steel Engineer*. Jun. 1996, pp. 20–26.

Roberts, William L. *Cold Rolling of Steel*. New York: Marcel Dekker, Inc., pp. 47–48 and 52.

*Primary Examiner*—Joseph J. Hail, III
*Assistant Examiner*—Ed Tolan
*Attorney, Agent, or Firm*—Oliff & Berridge, PLC

[57] ABSTRACT

It is possible, in a rolling method of a strip shifting one-side-tapered work rolls in the axial direction and causing the upper and the lower work rolls to cross each other, to appropriately set a quantity of shift and a crossing angle and to improve an edge drop satisfactorily, by utilizing the relationship of the three factors including the quantity of shift and the crossing angle for determining quantities of operation necessary to correcting an edge drop of the strip and the quantity of correction of edge drop corresponding to these quantities of operation in the form of the relationship between the roll gap between the upper and the lower work rolls and the quantity of correction of edge drop, by providing an effective roll gap reference position apart from the strip edge by a prescribed distance.

23 Claims, 28 Drawing Sheets

ROLLING METHOD AND ROLLING MILL OF STRIP FOR REDUCING EDGE DROP

BACKGROUND OF THE INVENTION

1. Field of the Invention

The invention relates to a rolling method of a strip and a rolling mill of a sheet material which permits, upon rolling a strip, particularly upon cold-rolling a steel sheet or the like, improvement of the edge drop, and achievement of a uniform thickness distribution in the width direction throughout the entire width.

2. Description of the Related Art

From among thickness deviations in the width direction produced in a strip (material to be rolled) during rolling, a sharp thickness reduction at the both ends in the width direction is known as an edge drop. In order to obtain a satisfactory rolled product with a uniform thickness distribution (thickness profile) in the width direction by rolling, it is necessary to reduce the edge drop.

It is one of the conventional control practices for reducing the edge drop to cause work rolls (hereinafter sometimes abbreviated as "WR") having a tapered end on one side to shift in the axial direction.

Japanese Patent Publication No. 2-34,241 discloses a method comprising the steps of estimating a thickness profile on the exit side of a rolling mill from the thickness distribution in the width direction of the starting strip on the entry side of the rolling mill, distribution of roll gap between upper and lower work rolls, and the printing ratio of the roll gap distribution onto the rolled product, collating this estimated value with a target thickness profile, and causing the work rolls to shift to a position where the difference between the two values is minimum.

Japanese Patent Publication No. 2-4,364 discloses a technique for alleviating the edge drop, comprising the steps of using a pair of work rolls at least each of which has a converging tapered end on one side, locating the tapered portions at ends on the both sides during rolling, and improving the geometry of the roll gap at the ends on the both sides. This patent publication discloses also a case of application of this technique to a cold-rolling tandem mill, where at least a first stand is provided with the work rolls having the tapered portion.

Japanese Unexamined Patent Publication No. 60-12,213 discloses a method of performing a shift control of work rolls to adjust the shift position of the work rolls, comprising the steps of comparing and calculating an observed value and a target value of the quantity of edge drop by means of an edge drop meter installed on the exit side of a final stand and controlling shifting of the work rolls on the basis of the results of comparison and calculation.

Japanese Patent Publication No. 6-71,611 discloses a method of adjusting the quantity of shift of work rolls on the basis of a difference between an edge drop of a starting strip material for rolling before rolling as measured with an edge drop meter installed on the entry side of a rolling mill and a target value thereof, and a difference between an edge drop of a product after rolling as measured with an edge drop meter installed on the exit side of the rolling mill and a target value thereof.

Japanese patent Publication No. 2-34,241 discloses a method, proposed by the present applicant, of incorporating a thickness distribution in the width direction of a strip material to be rolled on the entry side of a rolling mill as a control factor. This method includes estimating a thickness distribution on the exit side of the rolling mill (final stand) or in a product, by means of a thickness distribution in the width direction of the strip material to be rolled before rolling, a distribution of the roll gap between upper and lower work rolls, and a printing ratio of this roll gap distribution onto the rolled product, and setting a shift position of the work rolls so as to achieve a minimum difference between this estimated value and a target thickness distribution.

References "Sheet Crown Edge Drop Control Characteristics" (the 45th Plastic Working Federation Lecture Meeting Preprint, pp. 403–406, 1994) and "Edge Profile Control Using Pair Cross Mill in Cold Rolling" (Iron and Steel engineer, pp. 20–26, June 1996) disclose findings that, by causing upper and lower work rolls to cross each other, together with backup rolls on respective sides, there is available an effect of achieving a uniform thickness profile (thickness distribution in the width direction) under the action of a parabolic roll gap produced from the width center toward the strip end between the upper and the lower work rolls.

As a technique of combining a roll crossing and a roll shifting for upper and lower work rolls, for example, Japanese Unexamined Patent Publication No. 57-200,503 discloses a technique comprising the steps, in a roll crossing rolling mill comprising groups of upper rolls and lower rolls crossing at a prescribed angle, of achieving a uniform wear of the work rolls, reducing the frequency of roll polishing, and thus improving the consumption of rolls by displacing the relative position of the work rolls from among the roll groups relative to the strip material to be rolled in an axial direction of rolls.

Japanese Unexamined Patent Publication No. 5-185,125 discloses a method of operating the roll shift and the work roll bending force in response to the changing timing of the roll crossing angle with a view to reducing the rejectable range of strip flatness produced in the course of changing the roll crossing angle, while changing set values of operating conditions during running along with passage by a coil welding point (strip joint).

In the methods disclosed in the foregoing Japanese Unexamined Patent Publication No. 2-4,364 and Japanese Patent Publication No. 2-34,241, the taper is imparted to the work rolls by polishing prior to rolling. It is therefore impossible to change the quantity of taper or the shape during rolling. Work rolls are not usually replaced for each coil, but are in service for rolling of several tens of coils. Upon continuous rolling of several tens of coils, increasing the quantity of taper imparted to the work rolls is effective for a coil having a large edge drop in the material strip. For a coil having a small edge drop in the material strip, however, an increased taper is not effective and an excessive thickness are produced near the inside of the strip ends in the width direction. A decreased taper is, in contrast, effective for a coil having a small edge drop in the material strip, whereas a decreased taper cannot sometimes ensure sufficient improvement for a coil having a large edge drop in the material strip. These methods have therefore a problem in that a uniform thickness profile is not available for the entire width through improvement of edge drop for all coils.

Japanese Unexamined Patent Publication No. 2-34,241 does not take account of the edge drop occurring behavior at stands in the downstream of a stand (control stand) having a roll shifting mechanism capable of changing the thickness distribution in the width direction, thus leading to a decrease in the estimation accuracy of thickness deviation in the width direction on the exit side of the final stand. When conducting rolling at a shift position of work rolls set by this method, there is posed a problem in that the thickness distribution in the width direction on the exit side of the final stand does not agree with a target thickness distribution.

In order to take the edge drop occurring behavior in the individual stands into account, it is necessary to measure the thickness deviation in the width direction on the exit side of each stand. In a cold tandem mill, however, the distance between stands is small, and further, there occurs splash of cooling water or lubricant oil. It is therefore difficult to install a sensor for measuring a thickness distribution in the width direction, which causes another difficulty of a high installation cost. In a tandem rolling mill, therefore, it is practically impossible to measure the thickness distribution in the width direction between stands during rolling.

In the method disclosed in the aforesaid reference "Sheet Crown edge Drop Control Characteristics," the roll gap slowly expands in a parabolic shape from the width center toward the strip end. While this brings about an effect of improving the so-called body crown (sheet crown), no effect can be expected in the reduction of an edge drop which is a thickness deviation at the end of width.

In the aforesaid Japanese Patent Publication No. 57-206, 503 which has an object to prevent local wear of work rolls, it is impossible to control an edge drop.

The technique disclosed in the aforesaid Japanese Unexamined Patent Publication No. 5-185,125 has an object to prevent deterioration of a strip shape during the transition period for changing the crossing angle. A problem here is that an improvement effect of edge drop over that of the technique disclosed in the foregoing Japanese Unexamined Patent Publication No. 2-4,364 cannot be expected from this technique.

SUMMARY OF THE INVENTION

The invention was developed to solve the above-mentioned conventional problems. Particularly in a rolling process, the invention has an object to provide a rolling mill of a strip and a rolling method of a strip, which, when cold-rolling material strips to be rolled having various thickness profiles after a hot-rolling process, ensures reduction of an edge drop which is a sharp decrease in thickness occurring at ends in the width direction of the strip, and permits rolling into a uniform thickness throughout the entire width.

Another object of the invention is to obtain a satisfactory thickness distribution over the entire width, ranging from a slow thickness deviation (crown) occurring from the width center toward the strip end side, to a sharp thickness deviation (edge drop) occurring at the width end.

Further another object of the invention is to efficiently control the thickness distribution in the width direction on the exit side of a tandem rolling mill even when a control stand having operating means for changing the thickness distribution in the width direction of a strip in a tandem rolling mill is in the upstream of the final stand, and the strip is further rolled after the control stand.

The invention provides a rolling method of causing work rolls each having a tapered end, to shift in the axial direction and having the upper and the lower work rolls cross each other, which comprises the steps of determining a quantity of shift and a crossing angle as quantities of operation necessary for correcting an edge drop of the strip; causing the work rolls to shift by the quantity of shift thus determined, and having the work rolls cross each other at the crossing angle thus determined.

Further, the present invention provides a rolling method of a strip on a tandem rolling mill, incorporating the foregoing rolling method in at least one stand, in a method for rolling the strip continuously on the tandem rolling mill comprising a plurality of stands.

The present invention further provides a continuous rolling method of a strip on a tandem rolling mill, incorporating the first above-mentioned rolling method for two or more stands among the plurality of stands, comprising the steps of performing work roll shift control and work roll crossing control of the leading side stands on the basis of a thickness distribution detected before the leading side stands among the two or more stands, and conducting work roll crossing control of the trailing side stands on the basis of a thickness distribution detected after the trailing side stand among the two or more stands.

The present invention provides also a rolling mill for the application of the foregoing methods.

More specifically, the present invention provides a rolling mill of a strip, in which at least one of a pair of work rolls has a tapered end, provided with a shifting mechanism which causes the tapered roll to shift in the axial direction and a crossing mechanism which causes the rolls to rotate by a certain angle within the plane parallel to the rolling plane to achieve mutual crossing, which comprises control means which determines a quantity of shift and a crossing angle as quantities of operation necessary for correcting the edge drop of the strip; and sends the determined quantity of shift and crossing angle to the shifting mechanism and the crossing mechanism to cause the work rolls to shift by the quantity of shift and to cross each other by the crossing angle.

The other contents of the present invention will be clarified by the specification and the claims.

According to the present invention as described above, it is possible to improve the thickness distribution in the width direction of a strip, particularly to reduce an edge drop which is a sharp decrease in thickness occurring at width ends, and thus to roll the strip into a uniform thickness over the entire width.

It is also possible to appropriately share control by a plurality of stands and to obtain a satisfactory thickness distribution over the entire width, ranging from a slow thickness deviation (crown) occurring from the width center toward the strip ends to a sharp thickness deviation (edge drop) occurring at width ends.

It is also possible to effectively control the thickness distribution in the width direction on the exit side of a tandem rolling mill even when a control stand having operating means for changing the thickness distribution in the width direction of the strip is located in the upstream of the final stand, and rolling is continued in stands subsequent thereto.

DESCRIPTION OF THE PREFERRED EMBODIMENTS

First, shifting and crossing of work rolls having a tapered end on one side (hereinafter referred to as a "one-side-tapered WR") used in the present invention will be conceptually defined below with reference to FIGS. 2 to 4.

Figure 3:
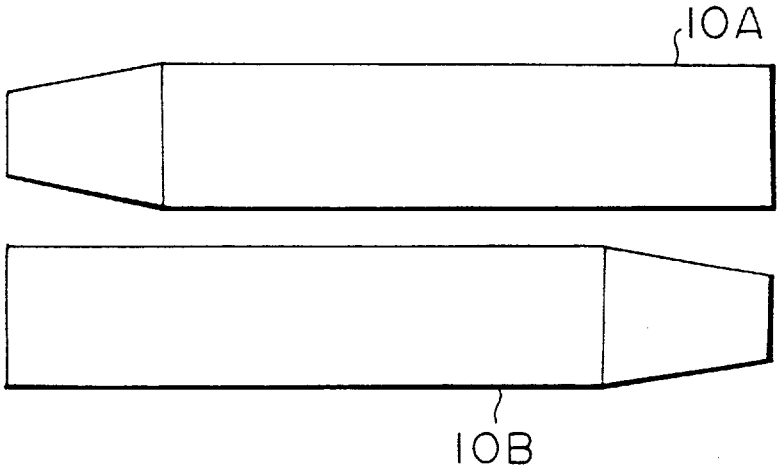
FIG. 3 is a conceptual front view illustrating work rolls.

FIG. 3 conceptually illustrates a rolling mill as viewed from the front. Shifting is an operation of causing work rolls, having a tapered end on one side at a roll end point-symmetrical of the upper and the lower work rolls, to shift in mutually reverse directions along the axis. The quantity of shift is the quantity of this displacement. More specifically, as shown in FIG. 4 illustrating an enlarged view of a tapered end, and the proximity thereof, EL is the distance between an end of a material strip S to be rolled and a taper starting point E. The quantity of taper of roll is defined as H/L as shown in FIG. 4.

Technically, tapering at least one end of at least one roll from among the upper and the lower work rolls would suffice to achieve the object of the invention.

Figure 2:
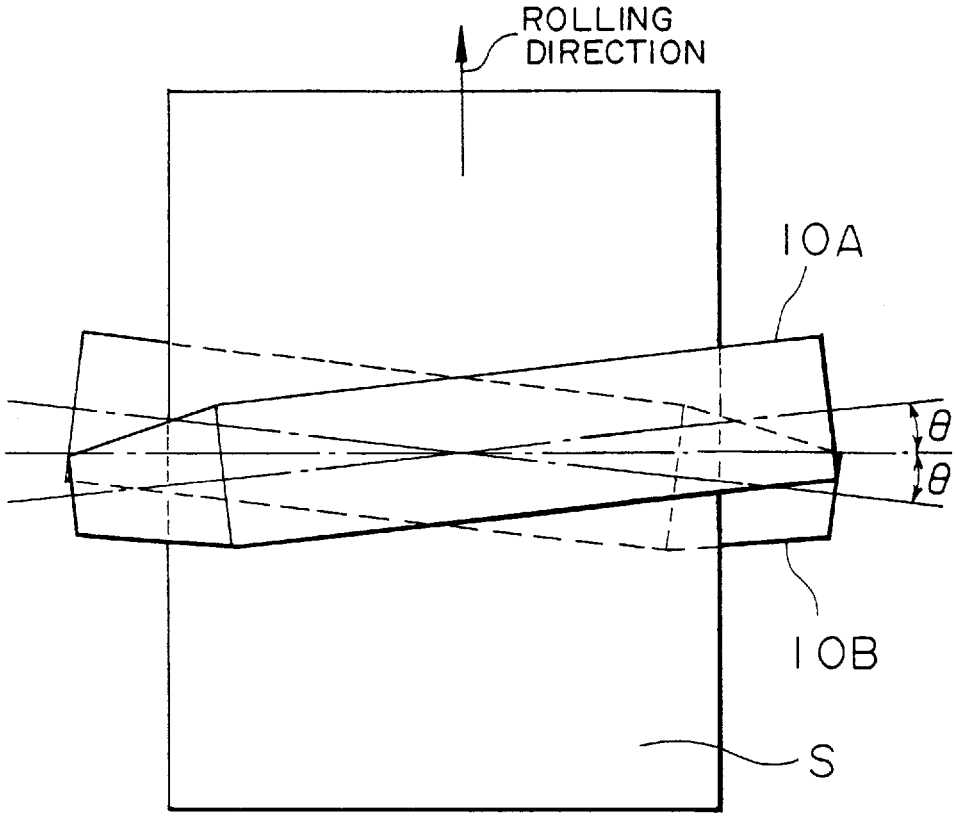
FIG. 2 is a plan view illustrating a crossing angle of work rolls.

FIG. 2 conceptually illustrates the rolling mill as viewed from above. Crossing is an operation of causing the upper and the lower work rolls to rotate in a plane in parallel with the rolling plane to achieve a mutual crossing as shown in FIG. 2. The crossing angle $\theta$ is a half the angle formed by the axes of the both work rolls.

From the technical point of view, the object of the invention can be achieved by causing at least one of the upper and the lower work rolls to rotate in a plane in parallel with the rolling plane.

Figure 5:
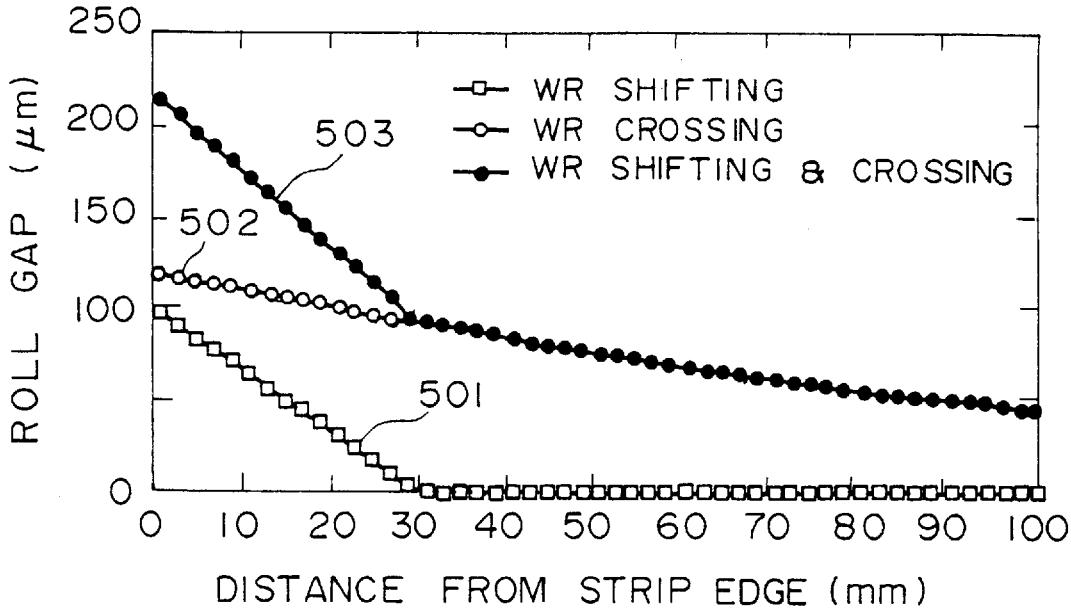
FIG. 5 is a graph for conceptual illustration of an effective roll gap of the invention (with the roll center as reference)

In FIG. 5, the reference numeral 501 is a typical roll gap produced by WR shifting. The reference numeral 502 represents a typical roll gap caused by WR crossing. A typical roll gap achieved by the simultaneous use of WR shifting and WR crossing is represented by the reference numeral 503. The term "roll gap" is defined as a gap between the upper and the lower WRs under no load with the roll center as reference.

In general, in strip rolling, a roll gap between WRs serves to improve the thickness profile of the rolled strip. This invention provides improvement of thickness profile and particularly of edge drop by combining one-side-tapered WR shifting and crossing.

In the foregoing improvement of thickness profile, particularly of edge drop, it is desirable to previously determine the relationship of three factors: the quantity of shift, the crossing angle and the quantity of correction of edge drop corresponding to these quantities of operation, and to determine a quantity of shift and a crossing angle on the basis of this relationship so as to obtain a desired quantity of correction of edge drop.

Further, the present inventors carried out extensive studies by conducting three kinds of rolling including a rolling causing WRs having a tapered end of roll to shift, a rolling of causing upper and lower WRs to cross each other, and a rolling using simultaneously WR shifting and WR crossing. As a result, they obtained findings that the portion of a roll gap corresponding to the strip end in a roll gap (gap between upper and lower WRs under no load) produced by shifting and crossing was particularly effective for improving the edge drop.

In the shift rolling, the cross rolling and the shift-cross combination rolling carried out by providing a reference position of effective roll gap at a position at a certain distance from the strip end, the roll gap with this reference position as reference and the quantity of improvement (correction) of edge drop could successfully be correlated. The possibility of controlling an edge drop was thus found by controlling the quantity of shift and the crossing angle of WRs.

More specifically, a roll gap is generally defined, as shown in FIG. 5, as a gap between upper and lower WRs under no load when the roll center is used as a reference (a roll gap at the roll center would be 0). In the present invention, however, there is used a concept in which an effective roll gap reference position is provided at a position at a certain distance, 100 mm for example, from the strip end (position apart from the strip end by 100 mm toward the width center), and the roll gap between the upper and the lower WRs with that position as reference (a roll gap at that position is set at 0) (hereinafter referred to as the "effective roll gap") is used.

Figure 6:
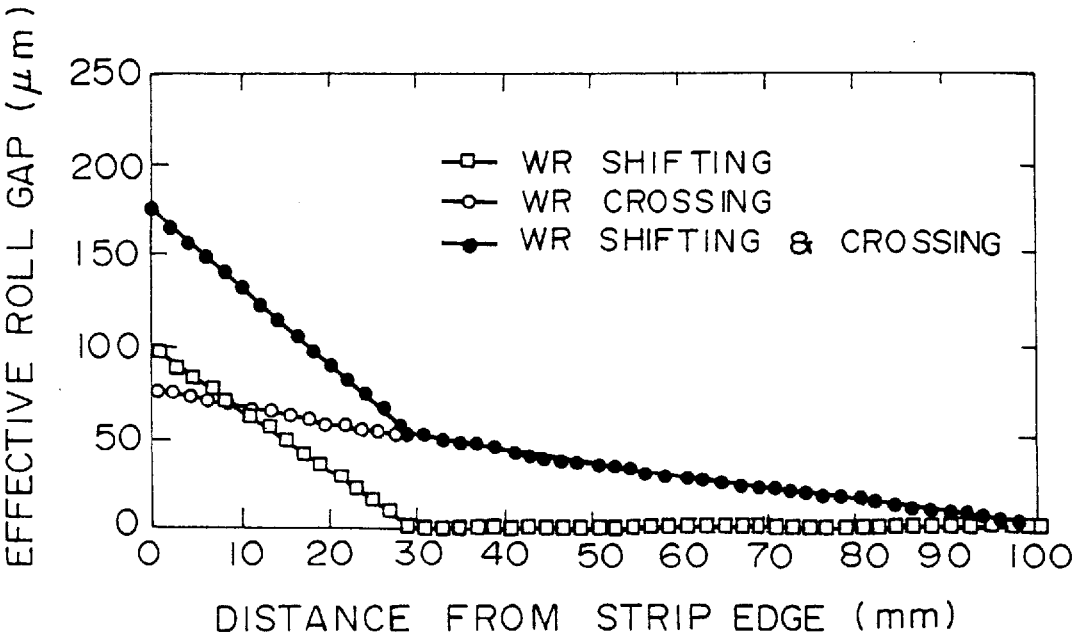
FIG. 6 is a graph for conceptual illustration of an effective roll gap of the invention (with the position of 100 mm from the strip end as reference)

FIG. 6 illustrates an effective roll gap defined with the position at 100 mm from the strip end as reference.

Figure 7:
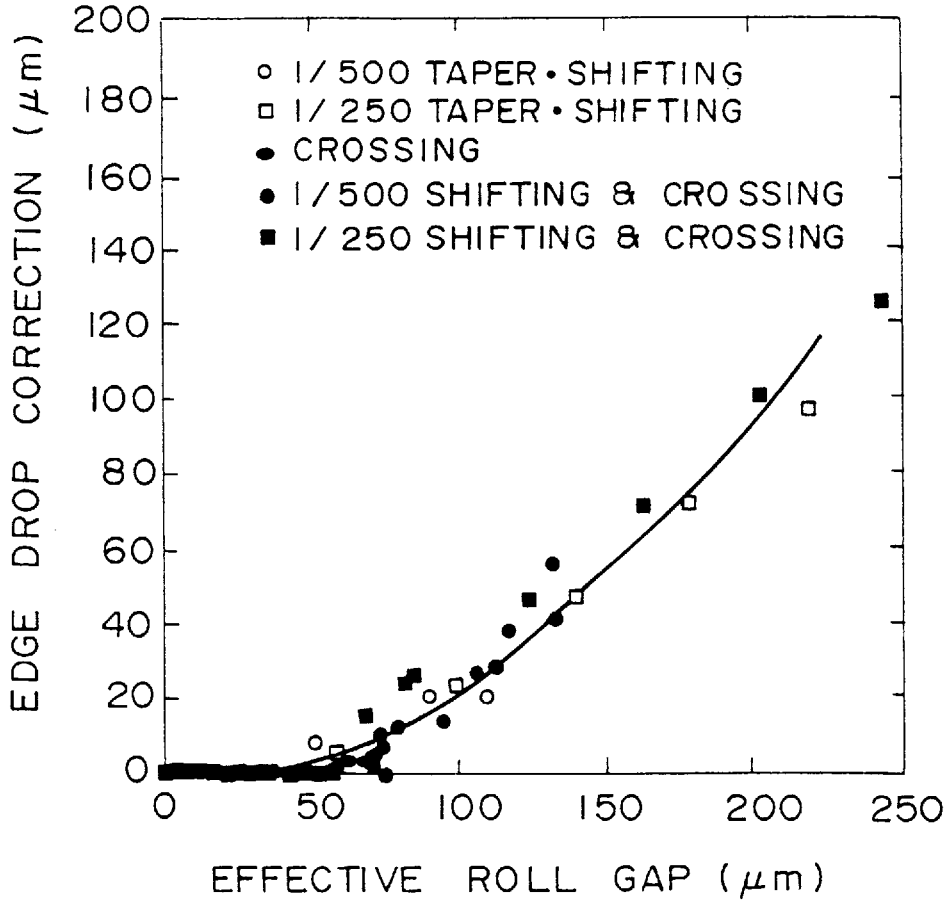
FIG. 7 is a graph illustrating the relationship between the effective roll gap and the quantity of correction of edge drop.

FIG. 7 illustrates the relationship between the effective roll gap and the quantity of correction of edge drop, as studied through a rolling experiment. In this experiment, two kinds of rolls having tapers of 1/500 and 1/250 were employed as WRs, with a quantity of WR shift within a range of from 0 to 70 mm and a WR crossing angle within a range of from 0° to 0.8°. The thickness deviation between a position of 15 mm from the strip end and a position of 100 mm from the strip end is defined as the quantity of edge drop. The quantity of correction of edge drop is the difference between the quantity of edge drop when rolling with flat rolls (with a quantity of shift of 0 mm and a crossing angle of 0°), on the one hand, and the quantity of edge drop when rolling with a prescribed quantity of shift and a prescribed crossing angle, on the other hand.

FIG. 7 suggests that, while the quantity of correction of edge drop is small when the effective roll gap is small, the quantity of correction of edge drop suddenly increases according as the effective roll gap becomes larger. By using the concept of the effective roll gap, therefore, it is possible to correlate the quantity of operation of the quantity of shift and the crossing angle with the quantity of correction of edge drop corresponding thereto.

While the position of 15 mm from the strip end has been used above to define the quantity of edge drop, the relationship between the effective roll gap and the edge drop is valid even for a position of, for example, 10 mm or 20 mm from the strip end. The reference position of effective roll gap may be changed in response to various conditions such as the thickness or deformation resistance of the material strip, the WR diameter and the rolling load, and this position is not limited to 100 mm from the strip end.

Since it is therefore possible to correlate the effective roll gap and the quantity of correction of edge drop as described above, it is also possible, in setting a quantity of shift and a crossing angle, to determine a quantity of shift and a crossing angle on the basis of the relationship between the effective roll gap and the quantity of correction of edge drop.

In addition, the present inventors conducted further extensive studies by carrying out rolling by causing upper and lower work rolls to cross each other by a prescribed amount in a rolling while adjusting the shift position in the axial direction of work rolls having a tapered end on one side of roll (one-side-tapered WR) (hereinafter referred to as the "one-side-tapered WR shift rolling"), and as a result, found through this experiment that the printing ratio varied when the upper and the lower work rolls were caused to cross each other by a prescribed amount. The printing ratio is expressed by the following formula (1) from the relationship between the quantity of change in roll gap and the quantity of change (quantity of correction) in edge drop:

$$\text{Printing ratio}=(\text{quantity of correction of edge drop}/\text{quantity of change in roll gap})\times 100\%] \quad (1)$$

Now, the printing ratio will be described in detail below.

First, the roll gap is a gap between an upper roll and a lower roll under no load, with that at the width center of work roll as the reference value. The quantity of change in roll gap means a quantity of change in roll gap when changing the quantity of shift from 0 mm to a prescribed quantity with a crossing angle kept constant.

Figure 8:
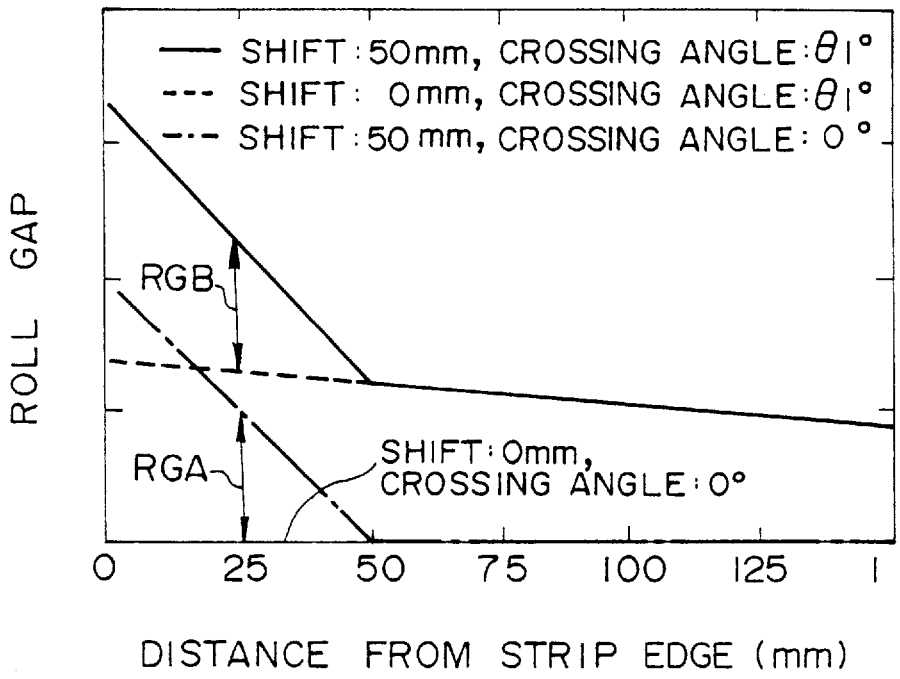
FIG. 8 is a graph for conceptual illustration of changes in the roll gap caused by shifting.

FIG. 8 conceptually illustrates the relationship between the roll gap and the quantity of shift. The quantity of change in roll gap will be described with reference to FIG. 8. Since a roll gap is always zero when a quantity of shift is 0 and a crossing angle is 0°, the quantity of change in roll gap when moving the quantity of shift from 0 mm to 50 mm while keeping a crossing angle at 0° is represented by RGA at a distance of 25 mm from the strip end. Similarly, if the quantity of shift with a crossing angle of θ1 corresponds to a roll gap of 0 mm as indicated by a dotted line, the quantity of change in roll gap when moving the quantity of shift from 0 mm to 50 mm is represented by RGB at a distance of 25 mm from the strip end.

The quantity of correction of edge drop is, the difference between the quantity of edge drop when rolling with rolls of a quantity of shift of 0 with a prescribed crossing angle, and the quantity of edge drop when rolling with rolls of a prescribed quantity of shift with said prescribed crossing angle. The quantity of edge drop means a thickness deviation in the width direction in the strip end region. The quantity of edge drop at an arbitrary position in the strip end portion is defined by means of a deviation between a thickness at a reference position at, for example, 100 mm from the strip end and thickness at the arbitrary position.

More particularly, the printing ratio of the formula (1) is the ratio, when adopting a crossing angle, of the quantity of change (quantity of correction) in edge drop of the strip after rolling with one-side-tapered WRs with a prescribed quantity of shift to the quantity of change in roll gap when moving the one-side-tapered WRs from a quantity of shift of 0 mm by a prescribed quantity.

Figure 9:
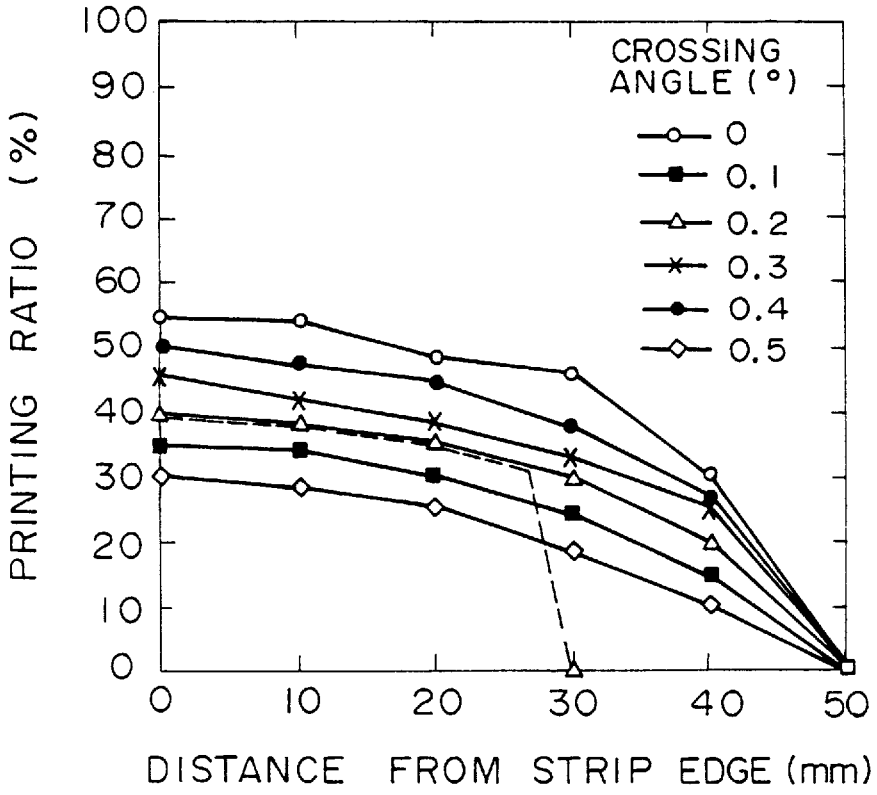
FIG. 9 is a graph illustrating the printing ratio when rolling is carried out by causing work rolls to shift and cross each other.

FIG. 9 illustrates a case where crossing of the upper and the lower work rolls leads to a change in the printing ratio as expressed by the formula (1). In rolling of a steel sheet for tinplate, the crossing angle of one-side-tapered WRs of a taper of 1/300 is changed from 0° to 0.5° at intervals of 0.1°, and for each crossing angle, the printing ratios at points of individual distances from the strip end with a quantity of shift of the work rolls of 50 mm are illustrated in FIG. 9.

The printing ratio available with a quantity of shift of 30 mm and a crossing angle of 0.2° is represented by a dotted line also in FIG. 9.

The results shown in FIG. 9 suggest that, in spite of the same quantity of taper of the work rolls, a larger crossing angle leads to a surprisingly larger printing ratio, except for the point at 50 mm from the strip end.

Conceivable reasons of this change in printing ratio are that the simultaneous use of one-side-tapered WR shifting and crossing results in (a) a steeper inclination of the tapered portion as compared with the case of one-side-tapered WR shifting alone, and (b) according as the rolling load at the strip ends decreases, tension at the strip ends unexpectedly increases so that the roll gap is more fully filled with the material.

With a constant crossing angle, the printing ratio has practically no relation with the quantity of shift, except for the proximity of the portion where the distance from the strip end agrees with the quantity of shift, even when changing the quantity of shift of the work rolls. The printing ratio with a crossing angle of 0.2° and a quantity of shift of 30 mm is added in the form of a dotted line in FIG. 9: in this case, the printing ratio is substantially the same as the value of printing ratio in the case with a quantity of shift of 50 mm.

By the simultaneous use of one-side-tapered WR shifting and crossing, as described above in detail, the printing ratio becomes variable even with work rolls of a constant quantity of taper, and availability of an effect substantially equal to that available with a variable quantity of taper is thus proved.

Since the printing ratio and the quantity of change in edge drop (quantity of correction) can be correlated as described above, it is possible to determine a quantity of shift and a crossing angle necessary for correcting the edge drop of a strip on the basis of the relationship of the quantity of shift, the printing ratio and the quantity of correction of edge drop corresponding to these quantities of operation, and the relationship between the crossing angle and the printing ratio, by previously determining the relationship of the quantity of change in edge drop relative to the crossing angle and the quantity of change in roll gap in setting a quantity of shift and a crossing angle.

In the rolling method of a strip described above, upon setting an edge drop control point, simultaneous use of shifting and crossing permit control of two points per side in the width direction of strip. It is therefore desirable to set at least two control points per side in the width direction.

Now, a method permitting obtaining a desired improvement of edge drop at edge drop control points by providing at least two points for controlling the quantity of edge drop per side in the width direction will be described below. The method comprises the steps of calculating an effective roll gap necessary for obtaining a desired quantity of correction of edge drop at two edge drop control points from the relationship between the effective roll gap and the quantity of correction of edge drop, calculating a quantity of shift and a crossing angle so as to give the desired effective roll gap at the two edge drop control points, and setting the thus calculated values.

The concrete steps will now be described below with reference to FIG. 10.

Figure 10:
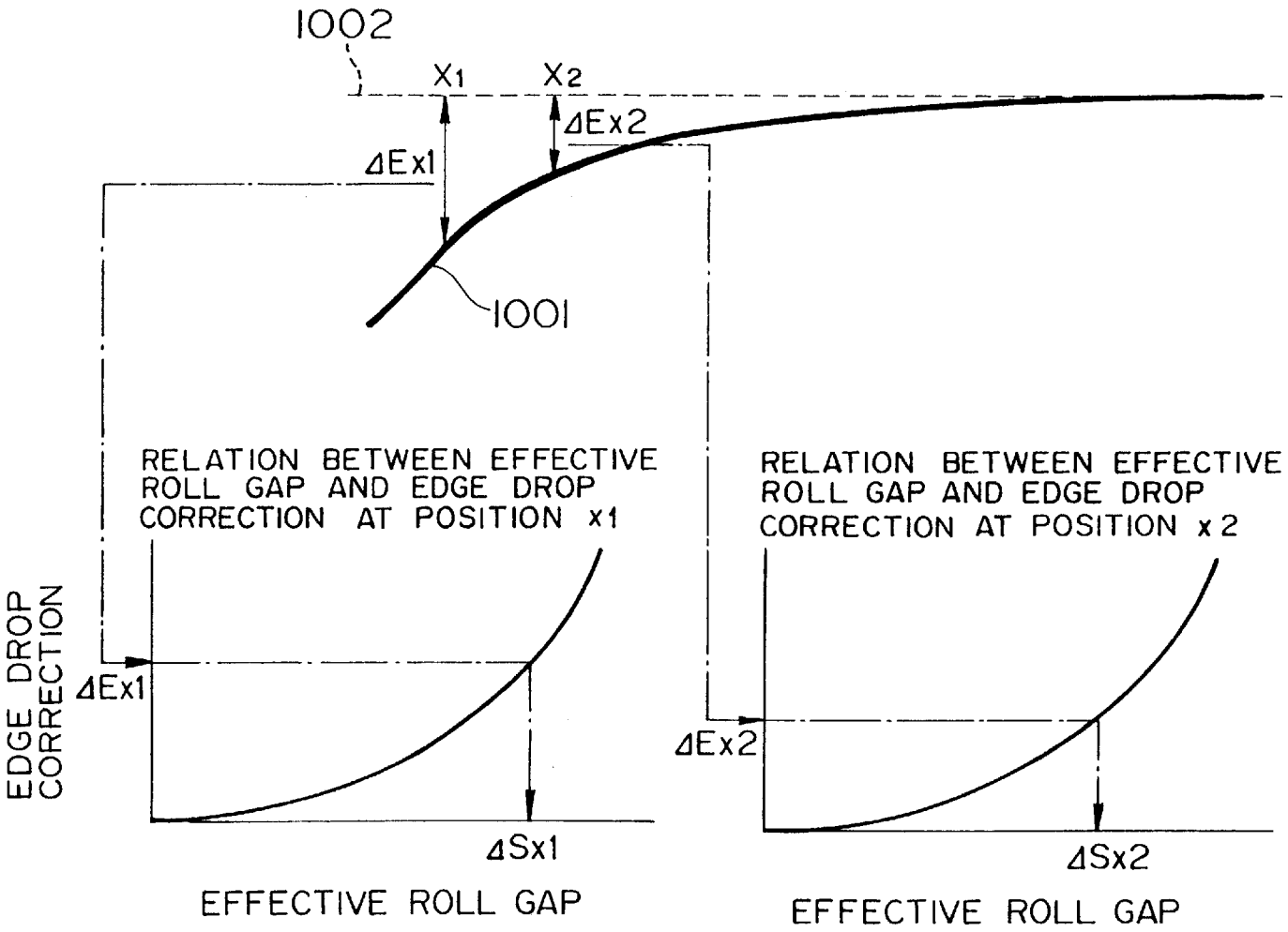
FIG. 10 is a descriptive view conceptually illustrating a control method based on the relationship between the effective roll gap and the quantity of correction of edge drop.

In FIG. 10, the reference numeral 1001 represents a thickness profile in rolling with flat rolls. Two points x1 and x2 are set as edge drop control points. The quantity of correction of edge drop necessary for improving the thickness profile in rolling with flat rolls into a target thickness profile (reference numeral 1002) is ΔEx1 for the control point x1, and ΔEx2 for the control point x2. Then, for the positions x1 and x2, effective roll gaps ΔSx1 and ΔSx2 for obtaining the desired quantity of correction of edge drop are determined from each relationship between the effective roll gap and the quantity of correction of edge drop. Then, a quantity of shift EL and a crossing angle θ for obtaining this effective roll gap are determined.

Because the usual quantity of shift is under 100 mm, an ffective roll gap $f_{x-100}$ (EL) at a position x mm in the strip end portion in WR shifting is defined as follows:

$$f_{x-100}(EL)=(EL-x)\cdot\tan(\alpha) \tag{2}$$

where,

EL: quantity of shift tan (α): quantity of taper.

The effective roll gap $g_{x-100}$ (θ) at the position x mm in the strip end portion in WR crossing is defined as follows:

$$g_{x-100}(\theta)=2\cdot\{(W/2-x)2-(W/2-100)2\}\cdot\tan 2\theta/DW \tag{3}$$

where,

θ: crossing angle

W: strip width

DW: WR diameter

It is therefore possible to determine the quantity of shift EL and the crossing angle θ can be calculated from the following formulae:

$$EL=\frac{(\Delta S_{x1}\cdot A_2-\Delta S_{x2}\cdot A_1)-\tan(\alpha)(A_2\cdot x1-A_1\cdot x2)}{A_2-A_1} \tag{4}$$

$$\theta=\tan^{-1}\sqrt{\{(\Delta S_{x1}-\Delta S_{x2})-(x1-x2)\}/(A_1-A_2)} \tag{5}$$

$$A1=\frac{2\cdot\{(2/W-x1)^2-(2/W-100)^2\}}{DW} \tag{6}$$

$$A2=\frac{2\cdot\{(2/W-x2)^2-(2/W-100)^2\}}{DW} \tag{7}$$

where,

W: strip width (mm)

DW: WR diameter (mm)

tan (α): quantity of taper (ex. 1/300)

Quantity of shift EL is under 100 mm.

In practical control, the thickness profile in rolling with flat rolls is calculated by previously preparing models or tables on the basis of rolling conditions and material conditions such as the strip thickness, the rolling load, and the quantity of edge drop in the material strip. The relationship between the effective roll gap and the quantity of correction of edge drop should also be previously prepared into mathematical models or tables which should be kept in storage.

According to the present invention, as described above, when controlling the edge drop in the strip by the use of a rolling mill provided with a mechanism for causing work rolls having a tapered end on one side to shift in the axial direction and a mechanism for causing the work rolls to cross each other, the operating steps comprise providing a reference position at a certain distance from the strip end (reference position of effective roll gap), calculating a quantity of roll gap necessary for achieving a desired improvement of edge drop on the basis of the relationship the effective roll gap between upper and lower WRs and the quantity of correction of edge drop, and determining a quantity of shift and a crossing angle so as to give that quantity of roll gap. It is therefore possible to ensure reduction of an edge drop which is a sharp decrease in thickness occurring at both ends in the width direction of the strip, relative to various thickness profiles of material strip, and to roll the strip into a uniform thickness over the entire width.

When setting edge drop control points in the foregoing rolling method, furthermore, control of the thickness profile is possible over a wide range in the width direction by simultaneously using shifting and crossing (in the width direction). By setting a first control point at a certain distance from the width center, and a second control point at a prescribed distance from the first control point toward the strip end, the crossing angle can be controlled on the basis of a thickness deviation between the thickness at the width center and the thickness at the first control point, and the quantity of shift of rolls can be controlled on the basis of a thickness deviation between the first control point and the second control point.

This control method will now be described below.

First, the relationship between edge drop and crown will be described as to a general work roll shifting and a general work roll crossing.

Figure 11:
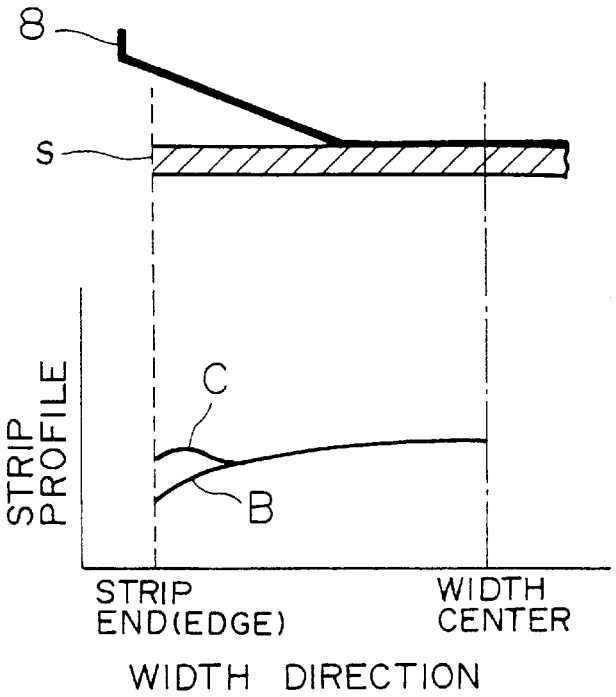
FIG. 11 is a graph illustrating typical changes in the thickness profile at a strip end in a usual work roll shifting.

In work roll shifting, as shown in FIG. 11, a gap is produced between the roll end and the strip s because of the taper imparted to the work rolls 8. When rolling a strip with such work rolls 8, the thickness profile takes the form of the solid line C, resulting in a local change in thickness at the strip ends, relative to the thickness profile (represented by a solid line B) produced in rolling with flat rolls without taper.

Figure 12:
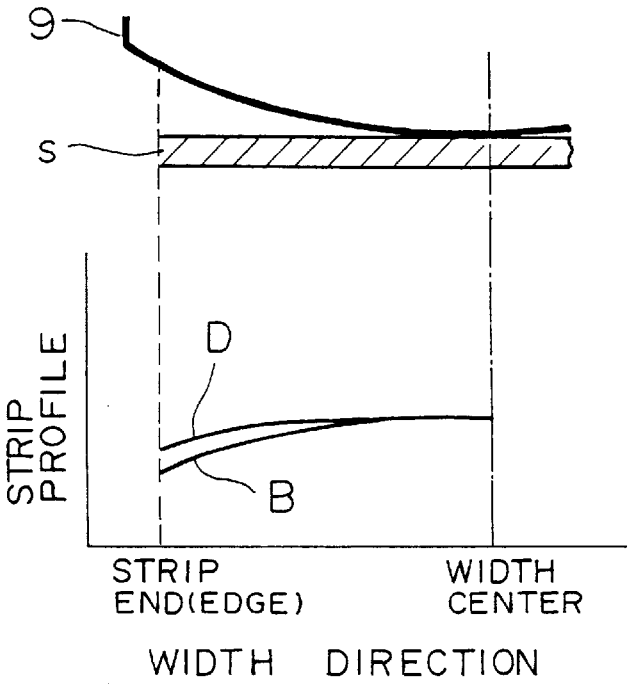
FIG. 12 is a graph illustrating typical changes in the thickness profile at a strip end in a usual work roll crossing.

In work roll crossing, on the other hand, as shown in FIG. 12, a gap parabolically expanding from the center toward the roll end is produced between upper and lower work rolls by causing the substantially flat work rolls 9 imparted only a roll crown to cross each other. When rolling is effected in this crossing state with a large crossing angle, the thickness profile takes the form as shown by a solid line D, and overall changes in thickness occur over a wide range including the end from a relatively inner portion of the width (on the width center side) relative to the thickness profile produced by flat roll rolling indicated by a solid line B.

Comparison of the thickness profile correcting effect of work roll crossing and the thickness profile correcting effect of work roll shifting demonstrates differences in quantity and shape. The edge drop of the steel sheet after cold rolling is caused by the edge drop in the material strip produced by the hot rolling which is the preceding process and the cold-rolling edge drop produced by cold rolling. The quantity and the shape of an edge drop in the strip after cold rolling largely vary with the thickness profile of the material strip.

Figure 13:
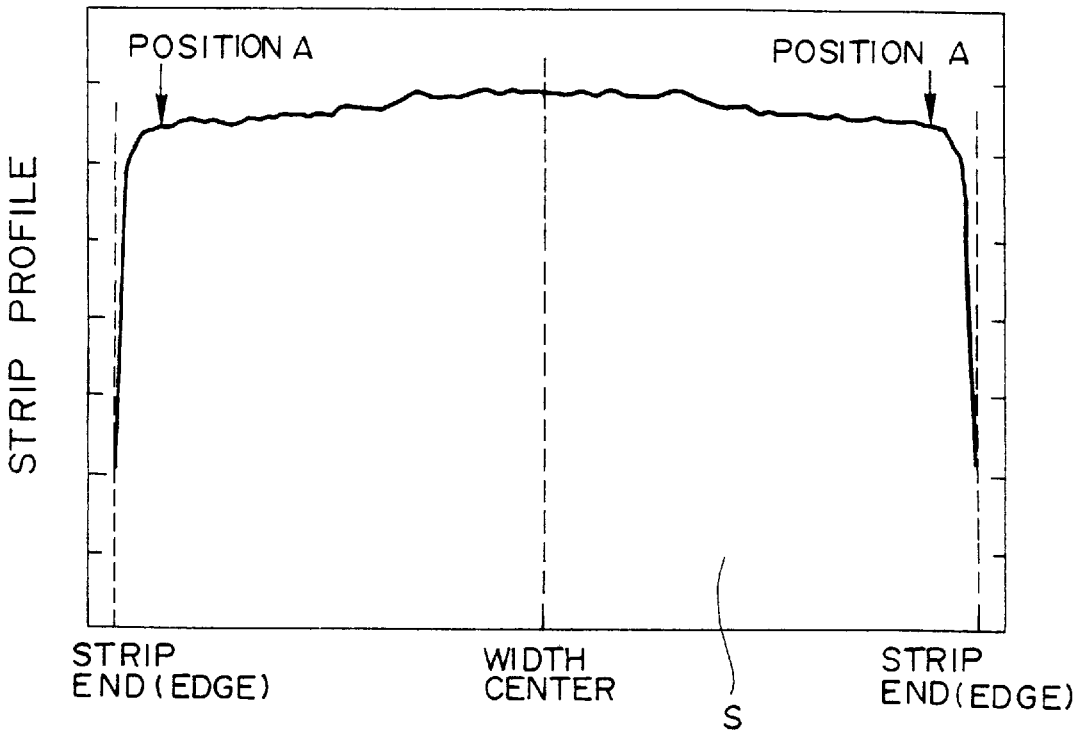
FIG. 13 is a graph illustrating a typical thickness distribution of a strip after cold rolling with usual flat rolls.

In general, a typical thickness distribution of the strip after cold rolling with flat rolls of a hot-rolled material strip is as shown in FIG. 13. While the thickness slowly decreases within a range from the thickness center to about the position A, decrease in thickness is sharp in a portion from the position A toward the strip end.

General matters have been described above. In order to achieve a satisfactory thickness distribution by eliminating a thickness deviation in the width direction in a strip having an edge drop coming from both a hot-rolling edge drop and a cold-rolling edge drop, it is clear from the present invention that it is effective to use a rolling mill provided with work rolls having a tapered roll end, a work roll shifting mechanism and a work roll crossing mechanism.

Figure 14:
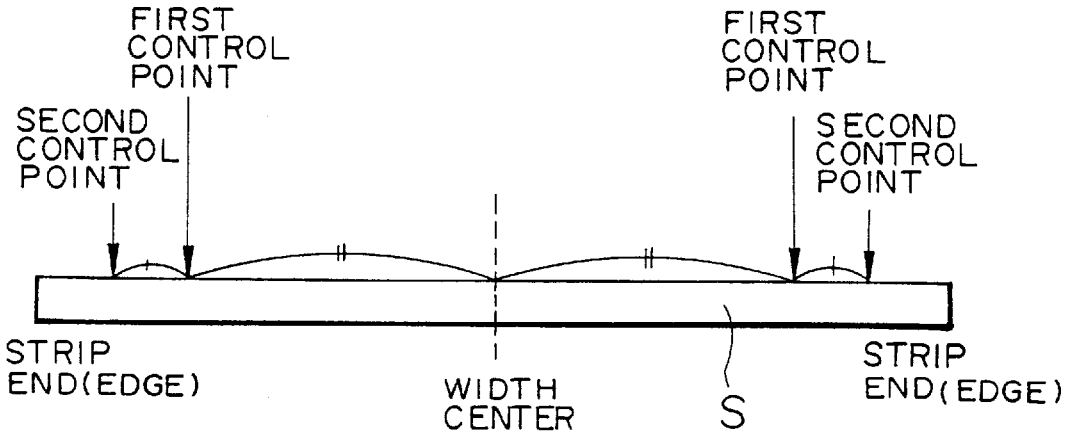
FIG. 14 is a width direction sectional view illustrating the positions of a first control point and a second control point in the invention.

In the present invention, as shown in FIG. 14, a first control point is set at a position apart from the width center by a prescribed distance as the position to achieve the effect of improving (correcting or controlling) the thickness deviation by roll crossing. Further, a second control point is set at a position apart from the foregoing first control point by a prescribed distance toward the strip end (edge) as the position for achieving the effect of improving the thickness deviation (edge drop) by roll shifting.

The first control point is located at a position where the thickness profile is correctable by roll crossing and is to permit correction of a thickness deviation at 100 mm from the strip end, for example, from that at the width center known in general as the body crown. The second control point is located, on the other hand, at a position closer to the strip end than the first control point, or at a position where the thickness profile is correctable by roll shifting to permit correction of a thickness deviation at a position of from 10 to 30 mm from the strip end from that at 100 mm from the strip end, known in general as the edge drop.

By the simultaneous use of shifting and crossing, as described above, the thickness profile can be controlled over a wide range (in the width direction).

For calculating a quantity of correction of edge drop necessary for correcting an edge drop, there are available:

- a method of calculating the foregoing quantity on the basis of a thickness distribution of a strip measured before the mill conducting control of the quantity of shift and the quantity of crossing of work rolls (shifting & crossing control stand);
- a method of calculating on the basis of a thickness distribution of a strip measured after a shifting & crossing control stand; and
- a method of calculating on the basis of a thickness distribution of a strip measured before a shifting & crossing control stand and after the shifting & crossing control stand.

When desiring to accurately control an edge drop from the coil leading end, and effectively control the edge drop against changes in the thickness profile of the material strip with the coil, material strip thickness profile information is useful. It is therefore desirable to measure the thickness distribution of the material strip to be rolled before the shifting & crossing control stand, and calculate a quantity of shift and a crossing angle on the basis of the thus measured result.

When desiring to cope with change in edge drop in trailing side stands and accurately control the quantity of edge drop in the final product, it is desirable to measure the thickness distribution of the material strip after the shifting & crossing control stand, and calculate a quantity of shift and a crossing angle on the basis of the result thereof.

Further, by carrying out measurement at the two aforesaid points and performing calculation on the basis of a thickness distribution of the material strip measured before the shifting & crossing control stand and a thickness distribution of the material strip measured after the shifting & crossing control stand, it is possible to control the edge drop at a high accuracy even for the leading end portion of a coil, effectively control changes in thickness profile in the coil, appropriately cope with changes in edge drop in the trailing side stands, and the control the quantity of edge drop in the final product at a high accuracy.

For rolling a strip on a tandem rolling mill having a plurality of stands, furthermore, at least one stand should serve as a shifting & crossing control stand.

In cold rolling, according to findings of the present inventors, a larger thickness of the material strip to be rolled on the entry side leads to formation of a larger edge drop. In a cold-rolling tandem mill, therefore, it is effective to improve edge drop in the first stand where the entry side thickness is the largest. In the tandem mill, therefore, it is effective and hence desirable to use the first stand as the shifting & crossing control stand.

By controlling an edge drop with the use of means simultaneously changing the shifting position of work rolls and changing the crossing angle in the first stand, an effect substantially equal to that making the quantity of taper variable is available, and by improving an edge drop, it is possible to improve edge drop for any thickness profile of the material strip and effectively obtain a thickness profile uniform in the width direction.

Embodiment 1

The following description of an embodiment of the invention will demonstrate that it is possible, in a rolling method of a strip by causing work rolls having a tapered end of roll to shift in the axial direction and causing the upper and the lower work rolls to cross each other, to appropriately set a quantity of shift and a crossing angle and to improve an edge drop satisfactorily, by utilizing the relationship of the three factors including the quantity of shift and the crossing angle for determining quantities of operation necessary for correcting an edge drop of the strip and the quantity of correction of edge drop corresponding to these quantities of operation in the form of the relationship between the roll gap between the upper and the lower work rolls and the quantity of correction of edge drop, by providing an effective roll gap reference position apart from the strip end by a prescribed distance.

Figure 1:
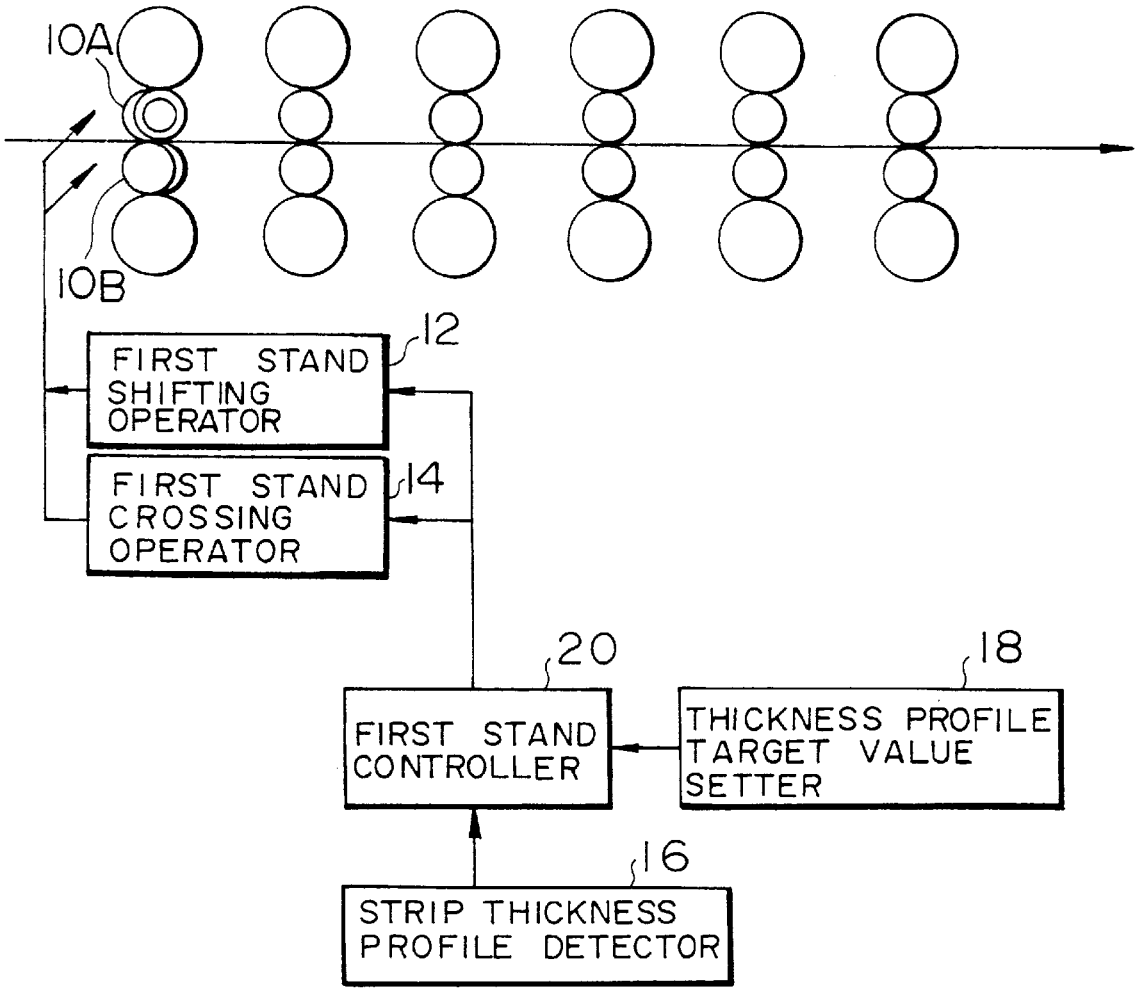
FIG. 1 is a descriptive view illustrating a schematic configuration of rolling facilities applied to embodiments 1 and 2 of the present invention.
Figure 15:
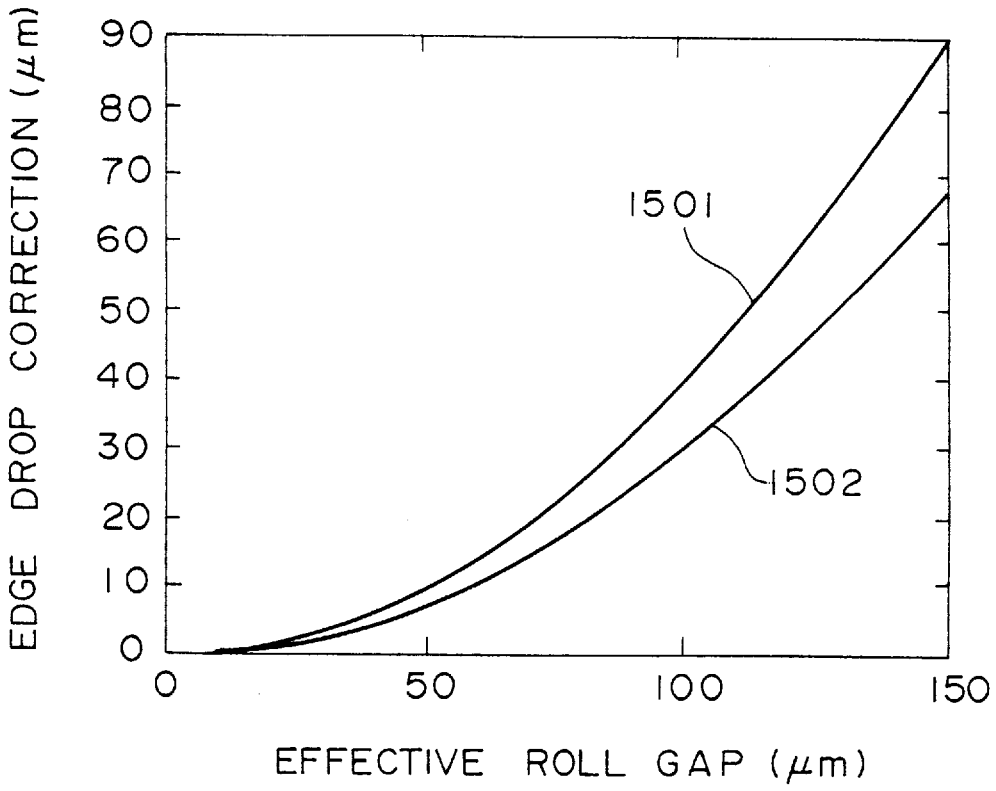
FIG. 15 is a graph illustrating the relationship between the effective roll gap and the quantity of correction of edge drop in an embodiment 1 of the invention.

A steel sheet for tinplate having a width of 900 mm, pickled after rolling was shifting & crossing-rolled on an equipment as shown in FIG. 1. Edge drop control points were provided at 10 mm and 30 mm from the strip end (strip edge). The target quantity of edge drop was 0 $\mu$m for any of these control points. In FIG. 15, the relationship between the effective roll gap and the quantity of correction of edge drop at positions of 10 mm and 30 mm from the strip end previously determined is represented by 1501 and 1502, respectively. The effective roll gap reference position was at 100 mm from the strip end. In this embodiment, these relations are formulated into the following mathematical models:

$$\Delta E\ 10 = 0.004 \times \Delta S\ 10^2 \quad (8)$$

$$\Delta E\ 30 = 0.003 \times \Delta S\ 30^2 \quad (9)$$

where,

- ΔE 10: Quantity of correction of edge drop at a position of 10 mm from the strip end;
- ΔS 10: Effective roll gap at a position of 10 mm from the strip end;
- ΔE 30: Quantity of correction of edge drop at a position of 30 mm from the strip end;
- ΔS 30: Effective roll gap at a position of 30 mm from the strip end.

The effect available when rolling the foregoing steel sheet will be described below with reference to FIG. 16.

Figure 16:
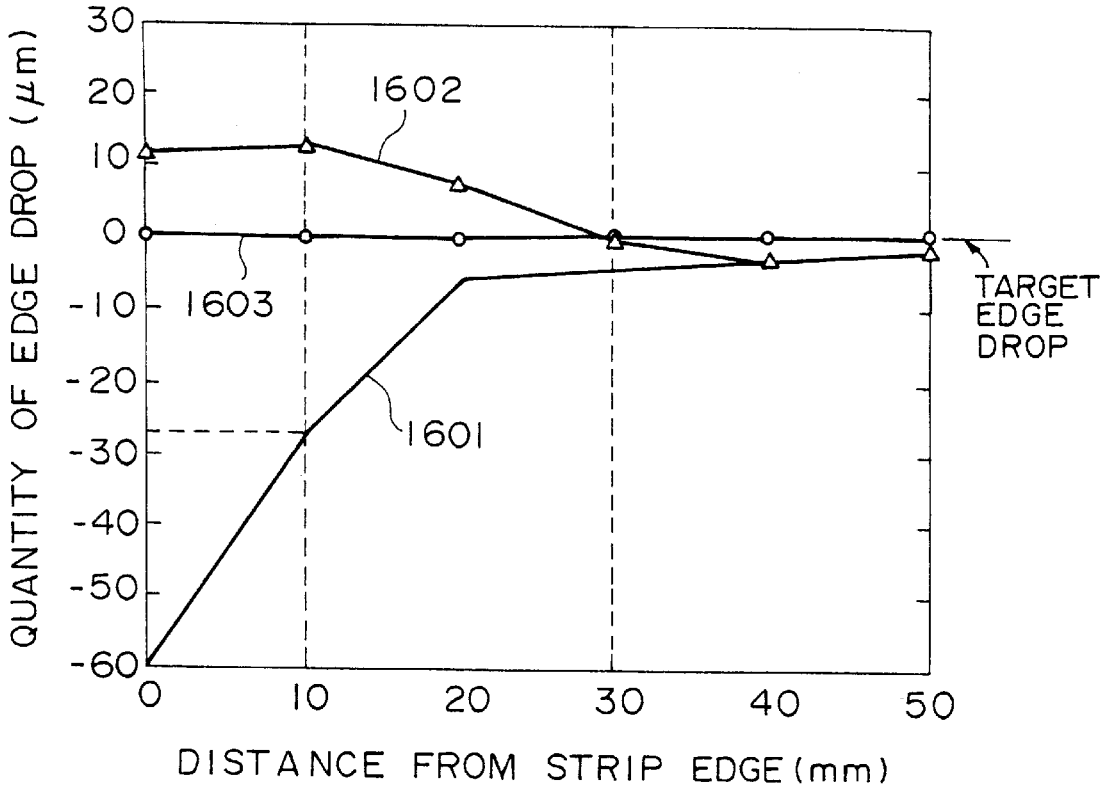
FIG. 16 is a graph illustrating the improvement effect of edge drop in the embodiment 1 of the invention.

In FIG. 16, the reference numeral 1601 represents a thickness profile at the strip end when rolling the steel sheet with flat WRs without taper. The reference numeral 1602 indicates a thickness profile at the strip end when rolling the steel sheet by the use of one-side-tapered WRs with a taper of 1/300 and a quantity of shift of 40 mm. At a position of 30 mm from the strip end, the edge drop could be corrected to a target edge drop. At the position of 10 mm from the strip end, however, the thickness was large by more than 10 $\mu$m, and it was thus impossible to roll the steel sheet into a uniform thickness over the entire width.

Now, the rolling mill and the rolling method of the invention as applied to a steel sheet similar to the above will be described. If the quantity of edge drop in rolling with flat WRs at a position of 10 mm from the strip end is E10, it is expressed by:

$$E10 = -27\ \mu m$$

from 1601 in FIG. 16. The quantity of correction of edge drop ΔE 10 necessary for correcting the edge drop to the target edge drop is therefore:

$$\Delta E\ 10 = 0 - (-27) = 27\ \mu m$$

The effective roll gap ΔS 10 necessary for obtaining this quantity of correction of edge drop ΔE 10 is as follows from the formula expressing the relationship between the effective roll gap and the quantity of correction of edge drop at the position of 10 mm from the strip end shown in the aforesaid formula (8):

$$\Delta S10 = \sqrt{(\Delta E10/0.004)} \approx 82\mu m$$

For the position of 30 mm from the strip end also, the effective roll gap is expressed as follows through similar steps:

$$\Delta S\ 30 \approx 37\ \mu m$$

By incorporating these values into the formulae (4) and (5):

$$EL = 20\ mm$$

$$\theta = 0.8^\circ$$

The quantity of shift EL and the crossing angle θ were thus calculated.

By conducting rolling by setting these values of the quantity of shift and the crossing angle, the edge drop could be corrected within the target range as shown by the reference numeral 1603 in FIG. 16.

According to the present invention, as described above, it was possible to accurately improve an edge drop which had conventionally been impossible, and as a result, to obtain a uniform thickness profile over the entire width.

Embodiment 2

The following description of another embodiment of the invention will demonstrate that it is possible, in a rolling method of a strip by causing work rolls having a tapered end of roll to shift in the axial direction and causing the upper and the lower work rolls to cross each other, to appropriately set a quantity of shift and a crossing angle and to correct an edge drop satisfactorily, by utilizing the relationship of the three factors indicating the quantity of shift and the crossing angle for determining quantities of operation necessary for correcting an edge drop of the strip and the quantity of correction of edge drop corresponding to these quantities of operation; determining a quantity of correction of edge drop necessary for correcting a quantity of edge drop of the strip into a target value on the basis of a previously determined relationship between the crossing angle and the ratio of the quantity of correction of edge drop to the quantity of change in roll gap; and determining a quantity of shift and a crossing angle necessary for correcting the edge drop of the strip on the basis of the quantity of shift, the ratio of the quantity of correction of edge drop to the quantity of change in roll gap, the relationship of the quantity of correction of edge drop therewith, and the relationship between the crossing angle and the ratio of the quantity of correction of edge drop to the quantity of change in roll gap.

FIG. 1 is a side view, including a block diagram, illustrating a schematic configuration of rolling facilities including a rolling mill of a second embodiment of the present invention.

The rolling facilities used in this embodiment is a cold tandem mill comprising six stands in total, having a rolling mill (shifting & crossing mill) provided with a shifting mechanism shifting work rolls having a tapered end on one side of roll and a crossing mechanism causing the upper and the lower work rolls to cross each other in a first stand.

The foregoing tandem rolling mill has a shift operator 12 which shifts the work rolls 10 in the first stand to a prescribed position, a crossing operator 14 which causes crossing of the upper and the lower work rolls at a prescribed angle, and a first stand controller 20 which issues a control signal to these operators 12 and 14.

This controller 20 calculates a quantity of shifting and a crossing angle which are quantities of operation of the first stand upon input of thickness profile information of the material strip before rolling as measured by a material strip thickness profile detector 16 installed on the exit side of a hot rolling mill (not shown) of the preceding process, and a target value after cold rolling set by a thickness profile target setter 18, and provides these quantity of shifting and crossing angle as an output to the foregoing operators 12 and 14, to control the work rolls to prescribed quantity of shift and crossing angle.

This controller 20 holds data regarding the relationship between predetermined crossing angle and printing ratio, and determines a quantity of shift and a crossing angle for correcting an edge drop of the material strip on the basis of the quantity of shift, the printing ratio, the relationship thereof with a quantity of correction of edge drop corresponding to these quantities of operation, and the relationship between the crossing angle and the printing ratio.

In this embodiment, the first stand is a four-high rolling mill comprising the work rolls and backup rolls, provided with the shifting mechanism and the crossing mechanism. This is schematically represented in an enlarged scale in FIGS. 17 and 18.

Figure 17:
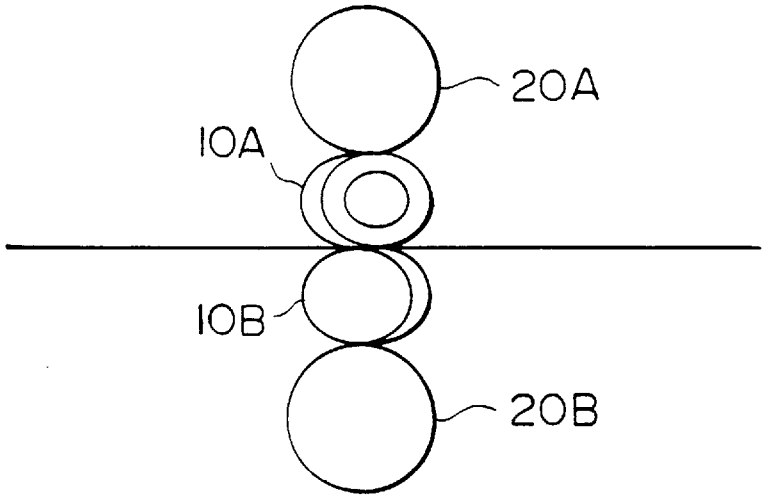
FIG. 17 is a schematic side view illustrating the rolling mill (stand) used in embodiments 1 and 2 of the invention.

In FIG. 17, the upper work roll 10A and the lower work roll 10B have tapered ends on opposite sides, not shown, and these upper and lower work rolls 10A and 10B are supported by an upper backup roll 20A and a lower backup roll 20B from above and below, respectively. The upper work roll 10A and the lower work roll 10B cross each other.

Figure 18:
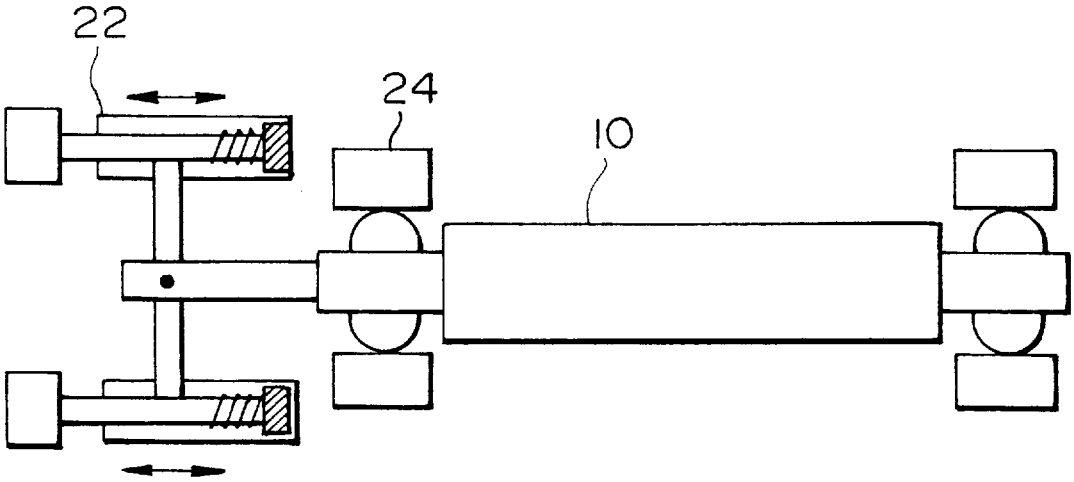
FIG. 18 is a schematic plan view illustrating the rolling mill (stand) (shifting unit, crossing unit and work rolls) in embodiments of the invention.

In this first stand mill, there are provided a shifting unit 22 and a crossing unit 24 of which an outline is illustrated as to a single work roll 10 in FIG. 18. These are operated by the shift operator 12 and the crossing operator 14 shown in FIG. 1 to cause shifting or crossing of the work roll 10 (10A, 10B).

The driving system of the shifting unit 22 may comprise any of a hydraulic motor and an electric motor. The crossing unit 24 causes the upper and the lower work rolls (10A, 10B) to cross each other by moving a chock by pushing of pulling on the entry/exit side of the WR chock, and it is possible to cause only the work rolls to cross each other or to cause crossing together with backup rolls.

In this embodiment, a steel sheet for tinplate having a width of 900 mm, pickled after rolling, was used as the material strip, and rolled with the use of one-side-tapered work rolls having a taper of 1/300 and a roll diameter of 570 mm.

Now, the effect available in rolling of the foregoing steel sheet on the above-mentioned rolling facilities will be described with reference to FIG. 19.

Figure 19:
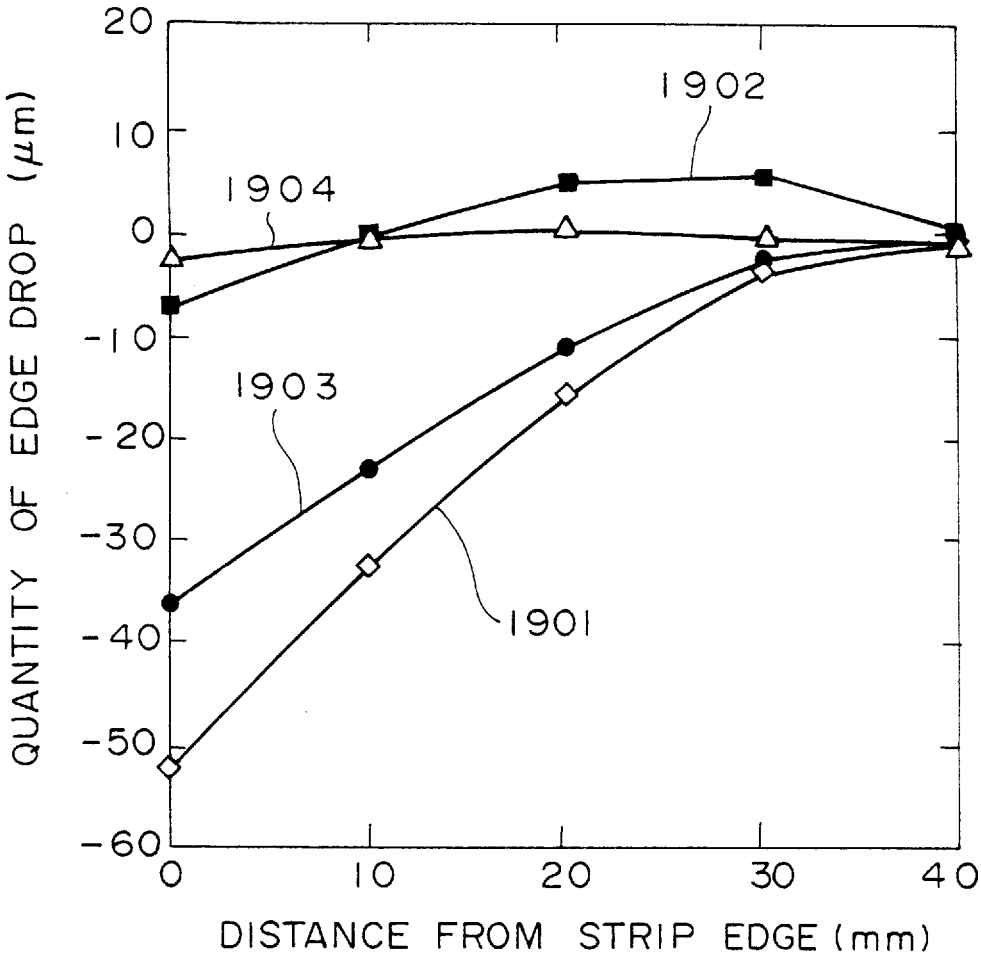
FIG. 19 is a graph illustrating the improvement effect of edge drop in the embodiment 2 of the invention.

In FIG. 19, the reference numeral 1901 indicates a thickness profile at the sheet end when rolling the steel sheet with flat rolls without taper.

A quantity of shift of 45 mm was necessary for correcting an edge drop with a target quantity of edge drop of 0 to 5 $\mu$m at a position of 10 mm from the sheet end (at a control point at 10 mm from the sheet end) by a conventional one-side-tapered WR shifting rolling (taper: 1/300). Determination of this quantity of shift of 45 mm will be described later for conveniences' sake.

The thickness profile obtained when carrying out a one-side-tapered WR shift rolling with an actual quantity of shift of 45 mm is indicated by the reference numeral 1902. In this case, while correction of edge drop was achieved as desired at the foregoing control point, an excessively thick portion occurred near the position of 20 to 30 mm apart from the control point toward interior, so that a uniform thickness profile could not be obtained.

In the case with only the conventional WR crossing, increasing the crossing angle to 1.0° which is the maximum angle permitting stable threading for rolling could not bring about a sufficient correction of edge drop as shown by 1903 representing the thickness profile.

The following paragraphs describe a case where the same steel sheet was rolled with a target quantity of edge drop of 0 to 5 $\mu$m at positions of 10 mm and 25 mm from the sheet end in this embodiment. The result is represented by the reference numeral 1904 in FIG. 19.

In this embodiment, the quantity of shift and the crossing angle of the one-side-tapered WR are determined as follows as set when rolling the sheet on the foregoing rolling mill.

More specifically, the relationship between the crossing angle and the printing ratio is previously determined as shown, for example, in FIG. 9. At the same time, a quantity of shift and a crossing angle suitable for correcting the edge drop of the rolled sheet are determined on the basis of the relationship of the quantity of shift, the printing ratio and the quantity of correction of edge drop corresponding to these quantities of operation, and the relationship between the crossing angle and the printing ratio.

The foregoing work rolls are shifted by the thus determined quantity of shift, and control is carried out to cause the upper and the lower work rolls to cross each other at the foregoing crossing angle.

At a position of Y mm from the sheet end (strip end), the quantity of correction of edge drop necessary for achieving a target quantity of edge drop of the rolled product is given by the deviation obtained by subtracting the quantity of edge drop in rolling with usual rolls from the target quantity of edge drop.

The necessary quantity of correction of edge drop has a relationship [quantity of change in roll gap]×[printing ratio] =[quantity of correction of edge drop]. The quantity of roll gap necessary for correcting an edge drop is expressed by [necessary quantity of change in roll gap]×[necessary quantity of correction of edge drop]=[printing ratio].

The above-mentioned necessary quantity of correction of edge drop is therefore incorporated into the term of the quantity of correction of edge drop of the formula (1). It is assumed here that the quantity of correction of edge drop at a position of 10 mm from the sheet end is ED10, and the quantity of correction of edge drop at a position of 25 mm from the sheet end is ED25. The relationship of the quantity of change in roll gap G, the printing ratio R and the quantity of correction of edge drop ED can be expressed by the following formulae (10) and (11), because the quantity of change in roll gap G is dependent only on the quantity of shift X, since the quantity of taper of the work rolls are known, the printing ratio R, not dependent on the quantity of shift X, but is dependent on the crossing angle θ:

$$ED10=G10\ (X)\cdot R10(\theta) \tag{10}$$

$$ED25=G25\ (X)\cdot R25(\theta) \tag{11}$$

A crossing angle θ and a quantity of shift X satisfying the above are determined by the following steps on the basis of FIG. 19.

Now, a manner for determination of the quantity of shift and the crossing angle suitable for correcting an edge drop will be described in detail with reference to FIG. 4.

Figure 4:
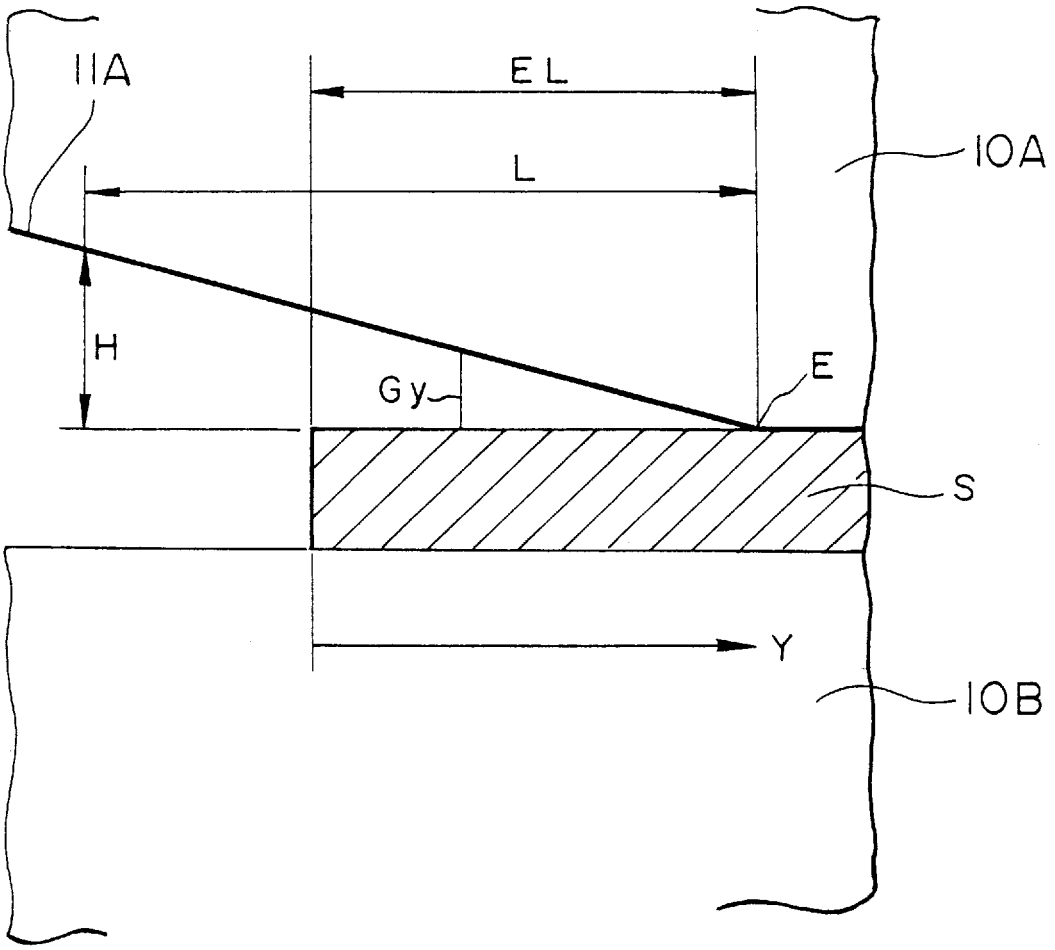
FIG. 4 is a descriptive view illustrating the relationship between the shift position of work rolls and the strip.

As shown in FIG. 4 schematically illustrating the relationship between work rolls and the strip S, the quantity of change in roll gap Gy(μm) at a position of Y mm from the sheet end in the case with a shift position EL (mm) would be as follows:

$$G10=(1/300)\times(EL-10)\times1000 \tag{12}$$

$$10\leqq EL$$

for a position of 10 mm from the sheet end, and $$G25=(1/300)\times(EL-25)\times1000 \tag{13}$$

$$25\leqq EL$$

for a position of 25 mm from the sheet end. In the formulae (12) and (13), ×1000 is a coefficient for using a unit of μm.

The quantity of correction of edge drop at a position of 10 mm from the sheet end in the case of flat roll rolling is 33 μm from FIG. 19, and the quantity of correction of edge drop at a position of 25 mm from the sheet end is 10 μm. The printing ratio Ry necessary for correcting an edge drop at a position of Y mm from the sheet end for roll gaps G10 and G25 would be, from the definition given in the formula (1) as follows:

$$R\ 10=33/G10 \tag{14}$$

for the position of 10 mm from the sheet end, and $$R\ 25=10/G25 \tag{15}$$

for the position of 25 mm from the sheet end.

From the relationship expressed in the formulae (12) to (15), the printing ratios at the positions of 10 mm and 25 mm from the sheet end at a quantity of shift of 33 mm would be 42% for the position of 10 mm from the sheet end, and 35% for the position of 25 mm from the sheet end, respectively. When the quantity of shift is smaller than 33 mm, the printing ratio becomes larger than the above, and when the quantity of shift is larger than 33 mm, in contrast, the printing ratio becomes smaller than the above.

On the other hand, the printing ratios for the positions of 10 mm and 25 mm from the sheet end, as determined while gradually increasing the crossing angle little by little from the relationship of the crossing angle with the distance from the sheet end and the printing ratio as shown in FIG. 9, are as shown in Table 1.

TABLE 1

| Crossing angle | Distance from strip end (mm) | |
|---|---|---|
| (°) | 10 | 25 |
| 0.2 | 38% | 33% |
| 0.3 | 42% | 35% |
| 0.4 | 47% | 40% |
| | printing ratio (%) | |

More particularly, with a crossing angle of 0.3°, the printing ratio is 42% for the position of 10 mm from the sheet end, and 35% for the position of 25 mm from the sheet end. These values agree with figures in the case with a quantity of shift of 33 mm. These results lead to a quantity of shift of 33 mm, and a crossing angle of 0.3°.

Now, the quantity of shift in the case with only the conventional one-side tapered WR shift rolling as described above will be determined below. The quantity of edge drop for the position of 10 mm from the sheet end is 33 μm similarly from the foregoing FIG. 19, and the printing ratio Ry is 28% from the value in the case of a crossing angle of 0° as shown in FIG. 9. The shift position EL (mm) for correcting the edge drop would be 45 mm as described above, as determined from the following formula (16):

$$0.28=33/G10 \tag{16}$$

$$G10=(1/300)\times(EL-10)\times1000$$

$$10\leqq EL$$

In the rolling simultaneously using one-side-tapered WR shifting and crossing of this embodiment, as described above in detail, in order to correct an edge drop as desired at the control point and to obtain a uniform thickness profile even at the other positions along the width direction, it was found to be necessary, with a quantity of shift EL of 33 mm, to ensure a printing ratio of about 42% for the control point (position of 10 mm from the sheet end) and about 35% at the position of 25 mm from the sheet end.

In this embodiment, as described above, a printing ratio with a crossing angle of 0.3° is adopted from FIG. 9 as the printing ratio the closest to the above printing ratio. By conducting a one-side-tapered WR shifting & crossing rolling with a quantity of shift of 33 mm at a crossing angle of 0.3°, as shown by the reference numeral 1904 in FIG. 19, it was possible to obtain a uniform thickness profile through correction of the edge drop without producing an excessively thick portion even toward interior from the control point.

According to this embodiment, as described above, it is possible to correct an edge drop, which was impossible in the conventional one-side-tapered WR shifting rolling or crossing alone, and as a result, to obtain a uniform thickness profile throughout the entire width.

Embodiment 3

The following description of further another embodiment of the invention will demonstrate that it is possible, in a rolling method of a strip by causing work rolls having a tapered end of roll to shift in the axial direction and causing the upper and the lower work rolls to cross each other, to appropriately set a quantity of shift and a crossing angle and to correct an edge drop satisfactorily, by setting a first control point apart from the width center by a prescribed distance and a second control point apart from the first control point by a prescribed distance toward the sheet end (strip end) as control points of thickness distribution in the width direction of the strip; controlling the crossing angle on the basis of the thickness deviation at the first control point from the thickness at the width center, and controlling the quantity of roll shift on the basis of the thickness deviation at the second control point from the thickness at the first control point.

Now, this embodiment of the width direction thickness control method of the invention will be described below in detail regarding a case of application to a six-stand cold rolling tandem mill provided with a roll shifting mechanism shifting one-side-tapered work rolls and a roll crossing mechanism causing the work rolls to cross each other in a first stand thereof, with reference to drawings. The embodiment will be divided into embodiments 3-1, 3-2 and 3-3 for convenience of description, which will be described sequentially.

Embodiment 3-1

Figure 20:
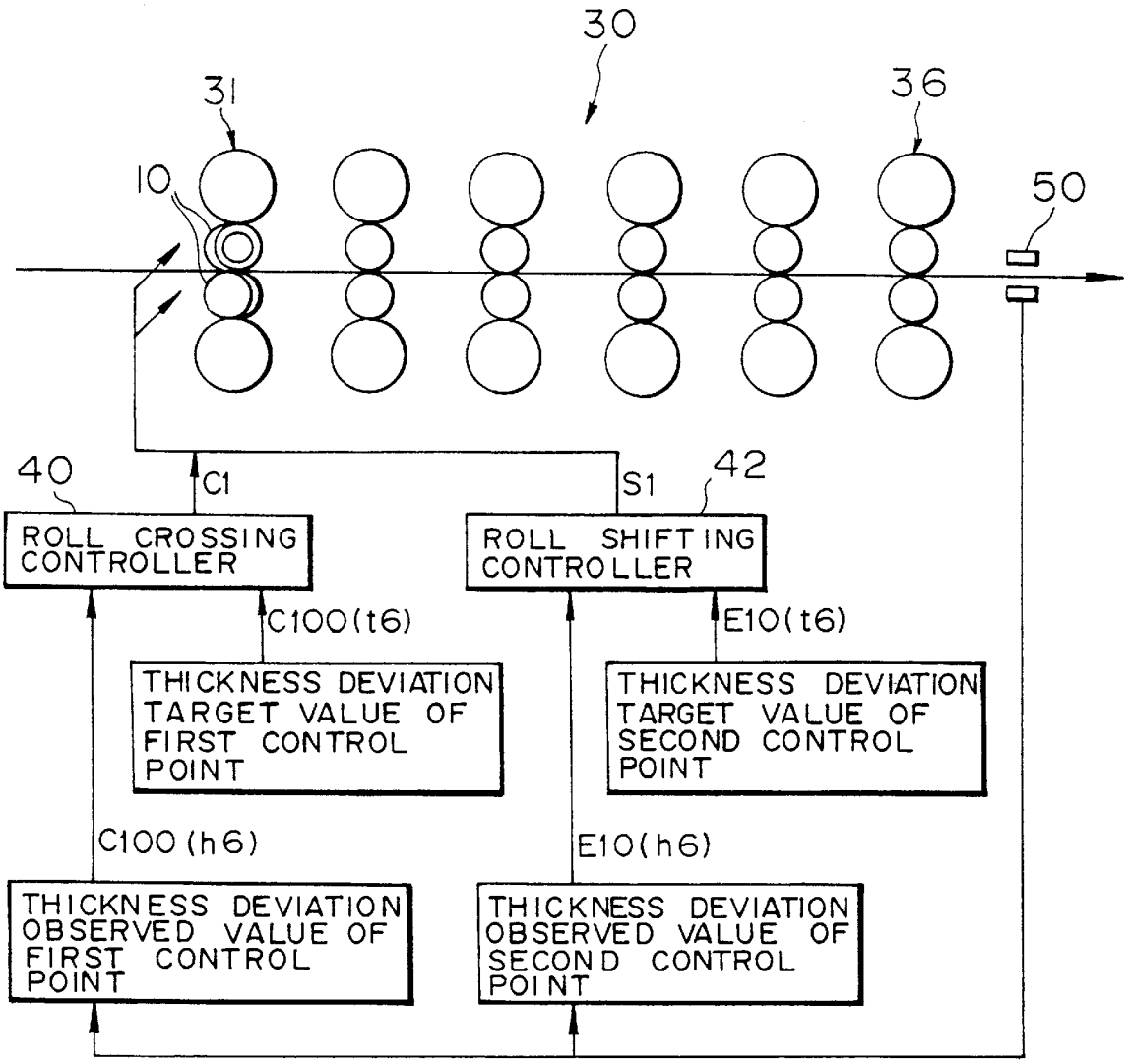
FIG. 20 is a block diagram illustrating the configuration of an embodiment 3-1 of the invention as applied to a six-stand cold-rolling tandem rolling mill.

FIG. 20 schematically illustrates a six-stand cold rolling tandem mill 30 to which the present invention is applied. A first stand 31 of this tandem rolling mill 30 comprises work rolls 10 having a tapered end on one side of roll, a roll crossing controller 40 for causing crossing of the work rolls 10, and a roll shifting controller 42 for shifting the work rolls 10. The work rolls 10 can perform work roll crossing under instruction of the roll crossing controller 40 and work roll shifting under instruction of the roll shifting controller 42.

In the embodiment 3-1 of the invention, as shown in FIG. 20, an exit-side (thickness) profile meter 50 for measuring the width direction thickness distribution of the strip after rolling is provided on the exit side of a final sixth stand 36, and conducts measurement with a cycle of, for example, 1 second.

A first control point of the width direction thickness deviation derived from an output of the exit-side profile meter 50 is provided at 100 mm from the strip end, and a second control point is provided at 10 mm from the strip end. Measured values of thickness deviation of the first control point and the second control point are defined as follows:

C 100 (h6): Thickness deviation value at the width center and at a position of 100 mm from the strip end as measured by the exit-side profile meter 50;

E 10 (h6): Thickness deviation value at positions of 100 mm and 10 mm (second control point) from the strip end as measured by the exit-side profile meter 50;

Target values of thickness deviation of the first control point and the second control point are defined as follows:

C 100 (t6): Target value of thickness deviation of the width center and a position of 100 mm from the strip end (first control point);

E 10 (t6): Target value of thickness deviation of a position of 100 mm from the strip end and a position of 10 mm from the strip end (second control point).

The foregoing roll crossing controller 40 determines, as to a thickness deviation measured value C 100 (h6) of the first control point measured with the foregoing exit-side profile meter 50, the deviation ΔC 100 (h6) from the thickness deviation target value C 100 (t6) of the first control point by the following formula:

$$\Delta C\ 100(h6)=C100(h6)-C100(t6) \tag{17}$$

Then, a quantity of correction of roll crossing C1 of the work roll 10 of the first stand 31 is calculated in response to the thus determined deviation ΔC 100 (h6). More specifically, for example, the relationship between the deviation ΔC 100 (h6) and a required quantity of correction C1 of crossing angle of the first stand relative to that deviation is previously determined as the influence index a. Calculation may be based on the following mathematical model:

$$C1=a\cdot\Delta C100(h6) \tag{18}$$

Further, the foregoing roll shifting controller 42 determines, as to the thickness deviation measured value (E 10 (h6) of the second control point measured by the foregoing exit-side profile meter 50, a deviation ΔE 10 (h6) from the thickness deviation target value E 10 (t6) of the first control point in accordance with the following formula:

$$\Delta E10(h6)=E10(h6)-E10(t6) \tag{19}$$

Then, a quantity of correction of roll shifting S1 of the work roll 10 of the first stand 31 is calculated in response to the thus determined deviation ΔE10 (h6). More specifically, for example, the relationship between the deviation ΔE 10 (h6) and a required quantity of correction S1 of roll shifting is previously determined as the influence index b. Calculation may be based on the following mathematical model:

$$S1=b\cdot\Delta E\ 10\ (h6) \tag{20}$$

The methods of calculating quantities of correction of roll crossing angle and roll shifting are not limited to those mentioned above based on the models, but a method of using a table prepared from measured values (observed values) and selecting a required quantity of correction therefrom may be adopted.

Embodiment 3-2

Figure 21:
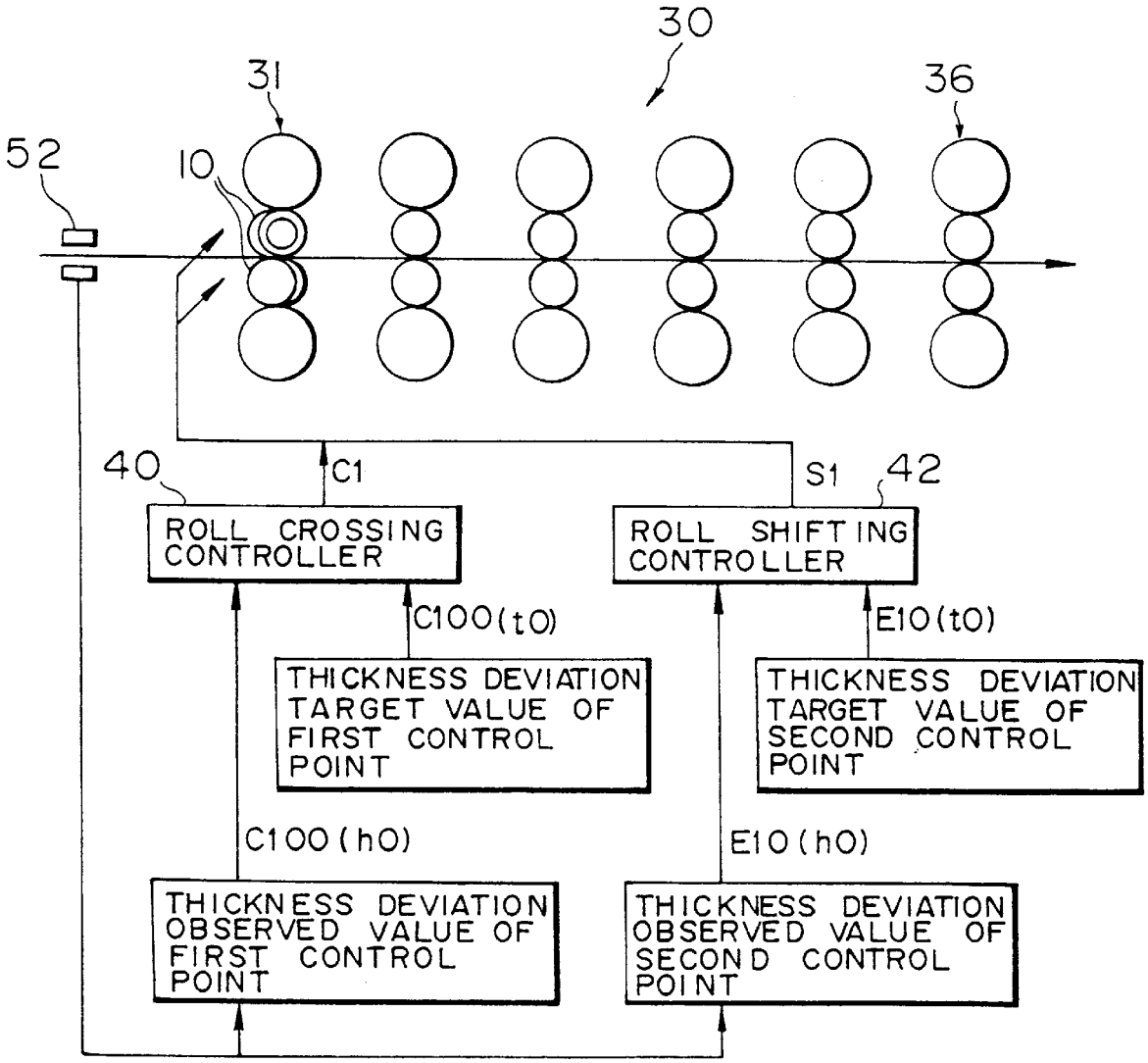
FIG. 21 is similarly a block diagram illustrating the configuration of an embodiment 3-2.

FIG. 21 illustrates another embodiment of the invention in which an entry-side (thickness) profile meter 52 is provided on the entry side of the first stand 31, and roll crossing and roll shifting are controlled on the basis of the width direction thickness distribution of the strip before rolling.

In this embodiment, the thickness deviation measured value between the width center and a position of 100 mm from the strip end (first control point) detected by the entry-side profile meter 52 is defined as C 100 (h0), and the thickness deviation at positions of 100 mm and 10 mm from the strip end detected by the entry-side profile meter 52 is defined as E 10 (h0). Target values for these deviations are defined as C 100 (t0) and E 10 (t0), respectively.

In this embodiment, the target values C 100 (t0) and E 10 (t0) of thickness deviations relative to the material strip are used as thickness deviations necessary for achieving a desired thickness distribution on the exit side of the final sixth stand 36, and are previously determined in response to the kind of steel and the thickness schedule on the basis of actual rolling results.

Regarding the method of calculating a quantity of correction of roll crossing C1 and the quantity of correction of roll shifting S1, being the same as that in the foregoing embodiment, a detailed description is omitted here.

The width direction thickness distribution of the material strip before rolling can be measured, for example in the case of cold rolling, by installing a thickness profile meter on the entry side of the cold mill, on the exit side of the hot mill or between the hot mill and the cold mill, or measure off line.

Embodiment 3-3

Figure 22:
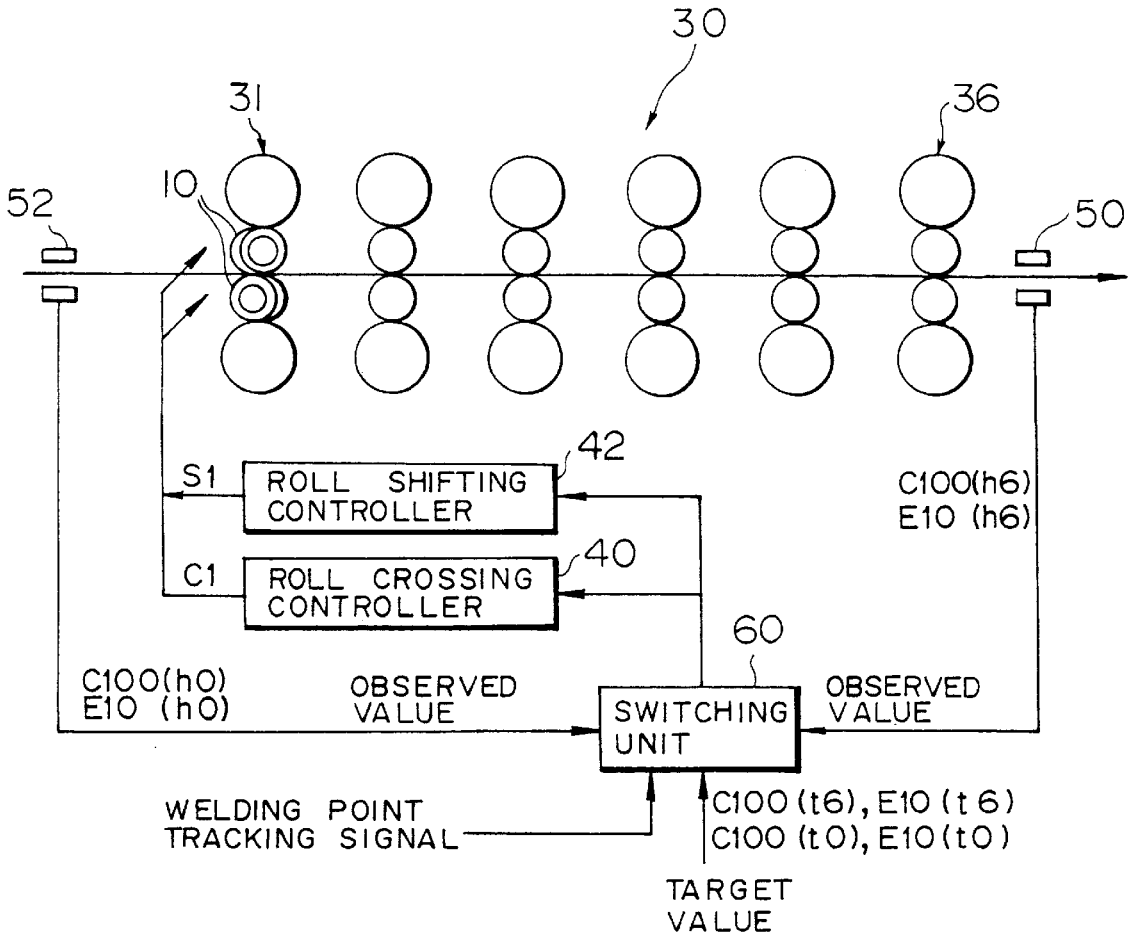
FIG. 22 is similarly a block diagram illustrating the configuration of an embodiment 3-3.

FIG. 22 illustrates an embodiment 3-3 of the invention simultaneously using an exit-side profile meter 50 as in the embodiment 3-1 and an entry-side profile meter 52 as in the embodiment 3-2.

In the embodiment 3-3, there is provided a switching unit 60 for switching (a) control by the roll crossing controller 40 and the roll shifting controller 42 operable in response to an output from the foregoing exit-side profile meter 50 to (b) control by the roll crossing controller 40 and the roll shifting controller 42 operable in response to an output from the foregoing entry-side profile meter 52 and vice versa. In compliance with tracking of welding points connecting a preceding steel sheet and a following steel sheet, the switching unit 60 performs a feedback control of roll crossing and roll shifting in response to an output from the exit-side profile meter 50. The switching unit 60 switches back the control again to feedback control performed in response to the output from the exit-side profile meter 50 at the point when the welding point reaches the position of the exit-side profile meter 50.

In the steady state, according to this embodiment 3-3, it is possible to certainly control the thickness distribution on the exit side of the final sixth stand 36 in response to the output from the exit-side profile meter 50, and while the welding point passes through the tandem rolling mill 30, appropriately perform feedforward control under the effect of the output from the entry-side profile meter 52.

Typical Results of Application of Embodiment 3

Figure 23:
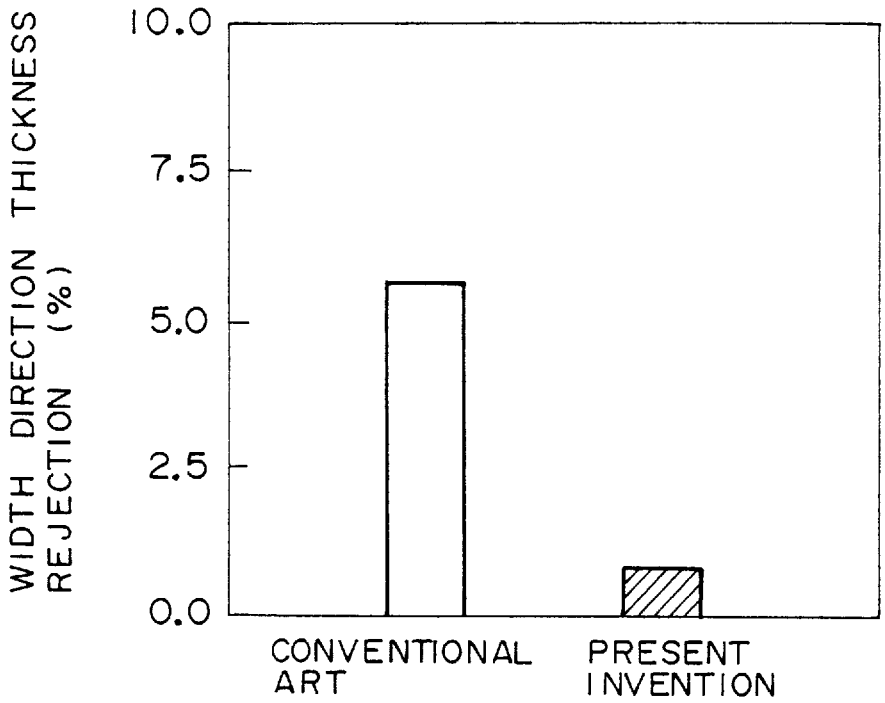
FIG. 23 is a graph comparing average values of width direction rejection rate between a conventional case and the embodiment 3-1 of the invention.

A steel sheet for tinplate, pickled after hot rolling, having a width of 900 mm was rolled for 20 coils. Average values of the missing ratio (width direction thickness rejection ratio) representing the ratio of the thickness distribution at positions of 100 mm and 10 mm in the longitudinal direction of the steel sheet, coming off a prescribed control range are compared in FIG. 23 between a conventional case using work roll shifting alone and the embodiment 3-1 of the invention. The taper had a shape having a radius reduced by 1 mm per 300 mm length in the barrel direction (taper: 1/300).

This permitted confirmation that the embodiment 3-1 brings about a remarkable improvement of thickness distribution in the width direction over that in the conventional method.

Availability of a similar result in the embodiment 3-2 could also be confirmed.

Embodiment 4

The following description of further another embodiment of the invention will demonstrate that it is possible to appropriately set a quantity of shift and a crossing angle and to correct an edge drop satisfactorily by calculating a quantity of correction of edge drop necessary for correcting the edge drop on the basis of a thickness distribution of the strip as measured after the rolling mill carrying out control of the quantity of shift and the quantity of crossing.

Figure 24:
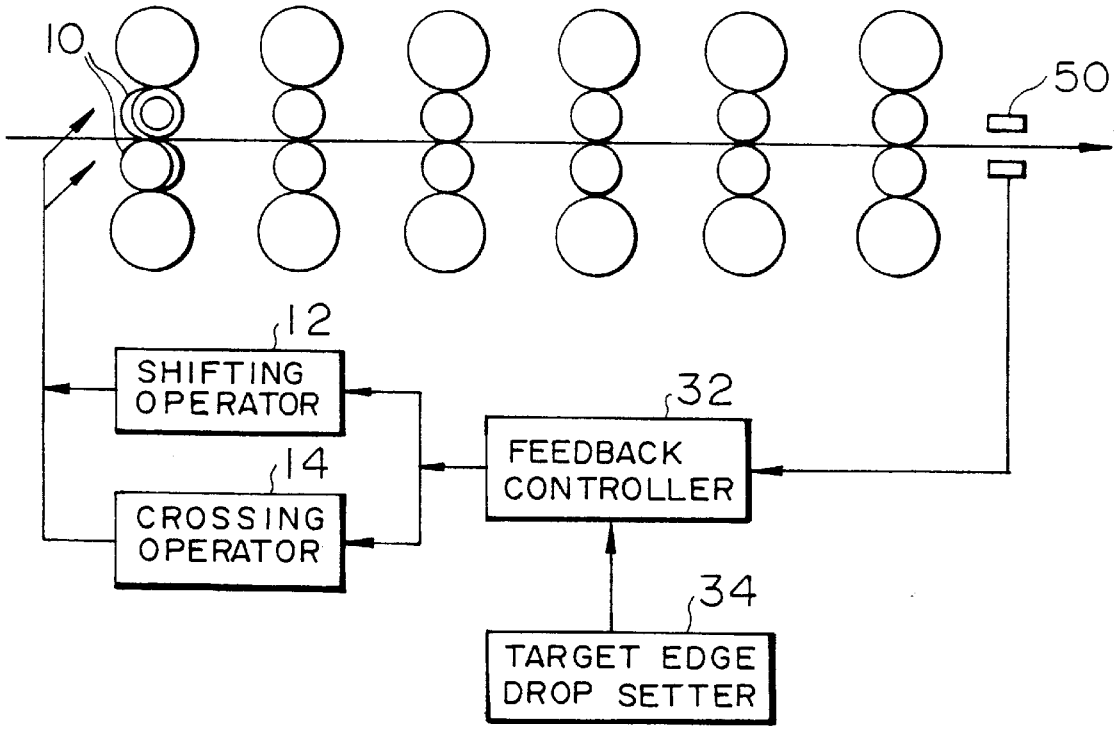
FIG. 24 is a descriptive view illustrating a schematic configuration of rolling facilities used in an embodiment 4 of the invention.

FIG. 24 is a side view, including a block diagram, illustrating a schematic configuration of a cold-rolling tandem mill comprising six stands in total used in the edge drop control method of this embodiment.

This tandem rolling mill comprises a four-high shifting & crossing mill provided with one-side-tapered work rolls only in a first stand. The work rolls 10 of the first stand are shifted by a shifting operator 12 and are caused to cross each other by a crossing operator 14.

A thickness profile meter 50 provided on the exit side of a final sixth stand (exit side of the mill) measures a quantity of edge drop at a prescribed control point on the strip. The thus measured quantity of edge drop is entered into a feedback controller 32. The controller 32 calculates a deviation (quantity of correction of edge drop) of this measured value entered as above from a target quantity of edge drop separately entered from a setting unit 34. A quantity of shift and a crossing angle necessary for dissolving the deviation are calculated, and these quantities of operation are sent to the foregoing shifting operator 12 and crossing operator 14 to control the first stand mill. In the controller 32, as described above, feedback control is conducted so as to achieve agreement of the quantity of edge drop measured on the exit side of the final stand with the target value.

More specifically, the controller 32 keeps data regarding the relationship between a predetermined crossing angle and the influence index. A quantity of shift and an influence index giving the foregoing necessary quantity of correction of edge drop in accordance with a principle described later in detail and on the basis of the relationship of the quantity of shift, the influence index, and the quantity of correction of edge drop corresponding to these quantities of operation. A quantity of shift and a crossing angle necessary for dissolving the above deviation are calculated by determining a crossing angle giving a desired influence index on the basis of the relationship between the crossing angle and the influence index.

Now, the principle of feedback control performed in this embodiment will be described below.

The present inventors carried out extensive studies on rolling simultaneously using one-side-tapered WR shifting and WR crossing (one-side-tapered WR shift/crossing rolling), and found that, not only for an edge drop on the exit side of the one-side-tapered WR shift/crossing mill (control stand), but also for an edge drop after further rolling on an ordinary mill (stand) in the downstream (for example, on the exit side of the final stand), as compared with a single one-side-tapered WR shifting rolling, the ratio of the quantity of change in edge drop to the quantity of change in roll gap caused by a change in the shift position (hereinafter referred to as the "influence index") increases, and the change in influence index depends upon the crossing angle.

Figure 25:
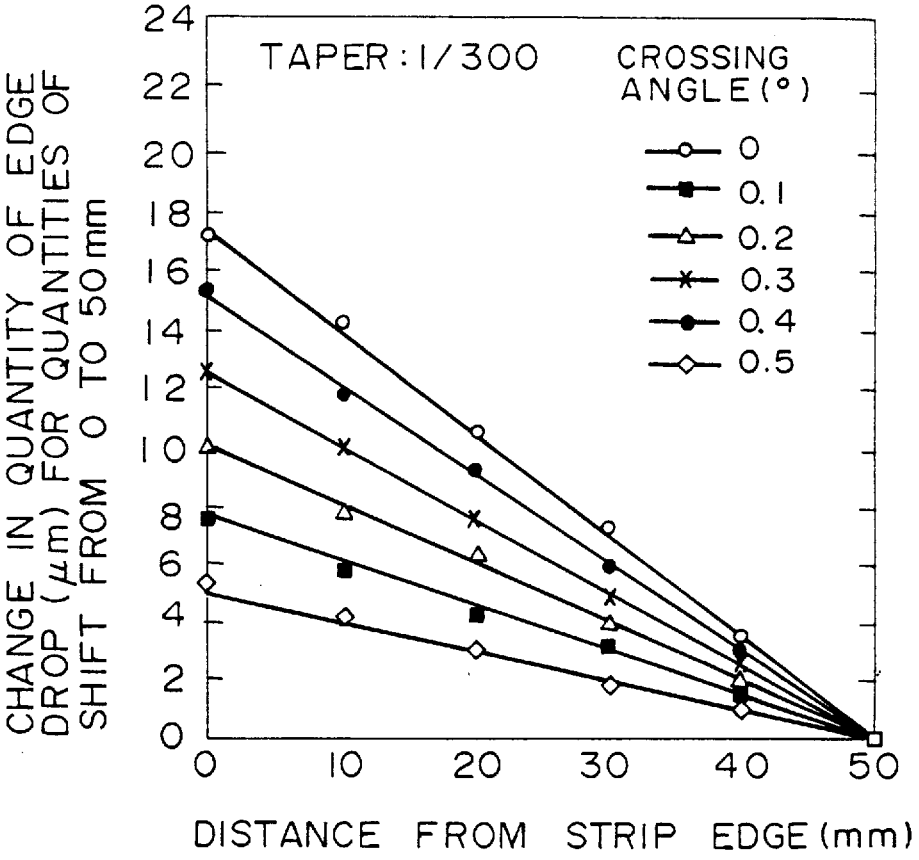
FIG. 25 is a graph illustrating the relationship between the quantity of change in edge drop on the exit side of the final stand and the crossing angle.

FIG. 25 illustrates the quantity of change in edge drop on the exit side of the mill of the final stand (sixth stand) in rolling of a steel sheet for tinplate with the use of one-side-tapered WRs of a taper of 1/300 installed in the first stand, with various crossing angles ranging from 0° to 0.5° at intervals of 0.1° and quantities of shift ranging from 0 mm to 50 mm. It is known from FIG. 25 that, in spite of the same quantity of taper of the work rolls, a larger crossing angle leads to a larger quantity of change in edge drop.

Figure 26:
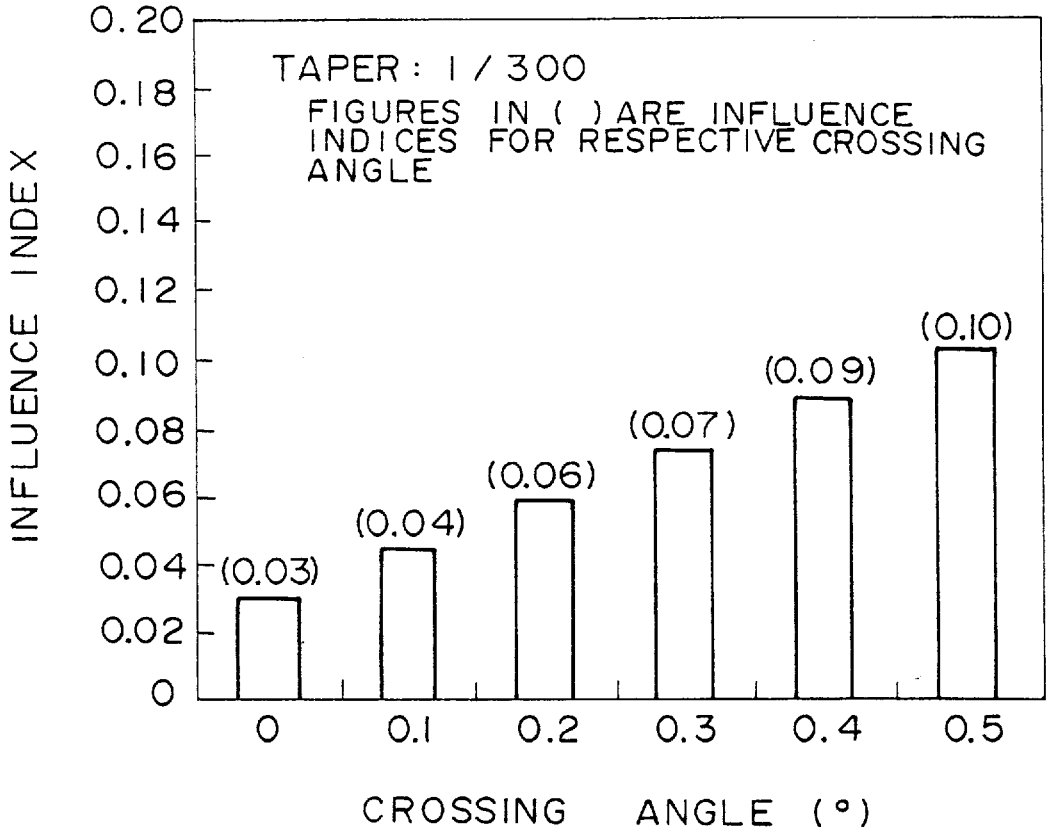
FIG. 26 is a graph illustrating the relationship between the crossing angle and the influence index, as applied in an embodiment 4 of the invention.

FIG. 26 illustrates influence index at each of the above-mentioned crossing angles: a larger crossing angle results in a larger influence index.

This is attributable to the fact that, as compared with the one-side-tapered WR shifting alone, the simultaneous use of one-side-tapered WR shifting and crossing results in a steep inclination of the tapered portion, leading to a decreased rolling load and a considerably increased deformation of the material resulting from an increased tension at the strip ends, and this remarkably amplifies the correcting effect of edge drop by the tapered portion. This remarkable amplification is an unexpected discovery.

In this embodiment, edge drop control is accomplished as follows in accordance with these findings.

Control of the quantity of edge drop will now be described below on the assumption that control is performed at two control points including positions of a mm and b mm from the sheet end (strip end) ($a \neq b$). The quantity of edge drop is a deviation in thickness between a reference position at a prescribed distance from the sheet end and the control point, and the direction toward a thinner thickness is defined as positive.

It is assumed here that the target quantity of edge drop for the positions at a mm and b mm is T(a) and T(b), respectively. The observed quantities of edge drop El(a) and El(b) at the control points at a point during rolling with a crossing angle θ1 and a quantity of shift EL1 mm are defined as follows:

El(a): Thickness deviation at the position at a mm from the sheet end from the reference position as measured by a thickness profile meter;

El(b): Thickness deviation at the position at b mm from the sheet end from the reference position as measured by a thickness profile meter.

In this embodiment, feedback control of changing the one-side-tapered WR quantity of shift and crossing angle is conducted so that the observed quantity of edge drop agrees with the target quantity of edge drop. In this control, the quantity of correction of edge drop for correcting an edge drop of the material to be rolled is equal to the deviation ΔE between the observed quantity of edge drop and the target quantity of edge drop at each control point, and is calculable by any of the following formulae:

$$\Delta E(a)=El(a)-T(a) \tag{21}$$

$$\Delta E(b)=El(b)-T(b) \tag{22}$$

The quantity of shift is changed from EL1 to EL2, and the crossing angle, from θ1 to θ2 through feedback control. If the influence indices for the angles θ1 and θ2 are K1 and K2, respectively, these indices depend upon the crossing angle. The influence indices can therefore be expressed as functions of the following formulae:

$$K1=K(\theta 1) \tag{23}$$

$$K2=K(\theta 2) \tag{24}$$

The following relational formulae are available from the deviations ΔE(a) and ΔE(b) of the observed quantities of edge drop at a mm and b mm from the sheet end from the target quantity of edge drop, and the roll gaps Ga(X) and Gb(X) at a mm and b mm from the sheet end with a quantity of shift EL, where L is a quantity of taper:

$$Ga(X)=L\cdot(EL-a) \tag{25}$$

$$Gb(X)=L\cdot(EL-b) \tag{26}$$

$$\Delta E(a)=Ga(X2)\cdot K2-Ga(X1)\cdot K1 \tag{27}$$

$$\Delta E(b)=Gb(X2)\cdot K2-Gb(X1)\cdot K1 \tag{28}$$

By incorporating the formulae (25) and (26) into the formulae (27) and (28), and solving them with regard to K2 and EL2, there are available the following formulae (29) and (30):

$$K2 = \{K1\cdot L\cdot(a-b)\cdot 1000-\Delta E(a)+\Delta E(b)\}/\{L\cdot(a-b)\cdot 1000\} \tag{29}$$

$$EL2 = \{\Delta E(a)\cdot b-\Delta E(b)\cdot 1000\}-L\cdot X1\cdot K1\cdot(a-b)\cdot 1000\}/\{\Delta E(a)-\Delta E(b)+L\cdot(EL1-a)\cdot K1\cdot 1000-L\cdot(EL1-b)\cdot K1\cdot 1000\} \tag{30}$$

A crossing angle θ2 giving an influence index K2 is selected from the previously determined relationship between the crossing angle and the influence index. The one-side-tapered WRs are caused to cross each other at this crossing angle and changes the shift position thereof until the quantity of shift becomes EL2.

Now, the following paragraphs describe, as a concrete example, a case where a steel sheet for tinplate having a thickness of 900 mm, pickled after hot rolling, is rolled on a tandem rolling mill shown in FIG. 24.

Positions at 10 mm and 30 mm from the sheet end are selected as control points of the quantity of edge drop, and the target of edge drop is 0 μm for the individual positions. The quantity of taper of the work rolls is 1/300. The relationship between the crossing angle of the work rolls and the quantity of change in edge drop is the same as that shown in FIG. 25. The relationship between the crossing angle and the influence index is the same as that shown in FIG. 26.

Figure 27:
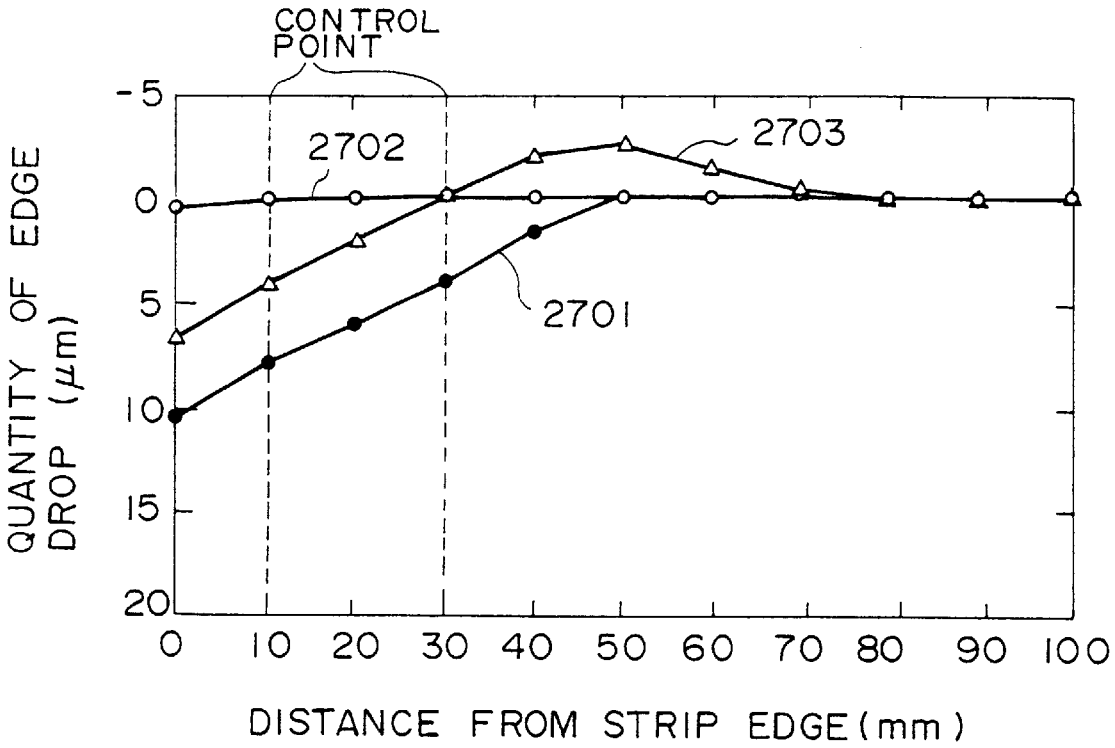
FIG. 27 is a graph illustrating the improvement effect of edge drop in the embodiment 4 of the invention.

The reference numeral 2701 in FIG. 27 shows the observed quantity of edge drop measured by means of the foregoing exit-side profile meter 50 during rolling with a crossing angle θ1=0° and a quantity of shift EL1=35 mm. Since El(10)=8 μm and El(30)=4 μm, and with a crossing angle of 0°, the influence index K1=0.03, the influence index K2 with a crossing angle after change and the quantity of shift EL2 after change are K2=0.09 and EL2=45 mm from the formulae (29) and (30). From FIG. 26, the crossing angle giving an influence index K2=0.09 is determined to be 0.40.

On the basis of this result, the crossing angle was changed from 0° to 0.4°, and the quantity of shift, from the position of 35 mm to the position of 45 mm. The resultant thickness profile is indicated by the reference numeral 2702 in FIG. 27. The edge drop was successfully corrected, resulting in a thickness profile uniform in the width direction.

For comparison purposes, the edge drop at the position of 30 mm from the sheet end is controlled to the target value of 0 μm with work roll shifting alone without conducting work roll crossing. The result of control is indicated by the reference numeral 2703.

In the comparative example, if the shift position is at 75 mm, the observed quantity of edge drop becomes 0 μm at a position of 30 mm from the sheet end (Δ and o overlap in FIG. 27). At a position of 10 mm from the sheet end, however, the quantity of edge drop becomes larger as about 4 μm, and at about 40 to 60 mm from the sheet end, thickness becomes excessively large, thus preventing achievement of a thickness profile uniform in the width direction.

According to this embodiment, as described above, it is possible to improve an edge drop far more successfully than in the conventional method. While a method using the mathematical models as expressed by the formulae (29) and (30) is used for the calculation of a quantity of necessary correction of the crossing angle and the quantity of shift, any other method not using such model formulae is also applicable. For example, a method of determination using a table prepared with actual result data may well be applicable.

It is therefore desirable to calculate a quantity of correction of edge drop necessary for correcting an edge drop on the basis of a thickness distribution of the material sheet measured after the rolling mill (control stand) controlling the quantity of shift and the quantity of crossing of the work rolls, thereby permitting appropriate setting of a quantity of shift and a crossing angle, and satisfactory correction of the edge drop.

Embodiment 5

The following description of an embodiment of the invention will demonstrate that it is possible, in a rolling method of a strip for continuously rolling a strip on a tandem mill comprising a plurality of stands, to appropriately set a quantity of shift and a crossing angle and to correct an edge drop satisfactorily, by providing a mechanism for shifting work rolls each having a tapered end and a mechanism of having an upper and a lower work rolls cross each other on at least one of stands except for the stand in the most downstream, predicting a thickness distribution in the width direction on the exit side of the first stand to provide a target thickness distribution in the width direction on the exit side of the tandem mill, using the predicted thickness distribution as a target thickness distribution on the exit side of the first stand, and causing the work rolls to shift and cross each other on the first stand.

When providing means for changing the thickness distribution in the width direction of the material strip such as a roll shifting mechanism or a roll crossing mechanism on a stand in the upstream of the final stand of the tandem mill, the quantity of edge drop on the exit side of the tandem mill (exit side of the final stand) is determined from the thickness deviation in the width direction of the material strip, the kind of the material strip, the thickness schedule, and the rolling conditions including the rolling load of the individual stands, in addition to the thickness profile on the exit side of the control stand provided with the means for changing the thickness distribution in the width direction.

Figure 28:
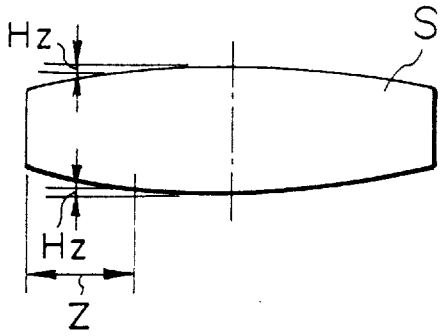
FIG. 28 is a sectional view illustrating the definition of edge drop in a material strip in an embodiment 5 of the invention.
Figure 29:
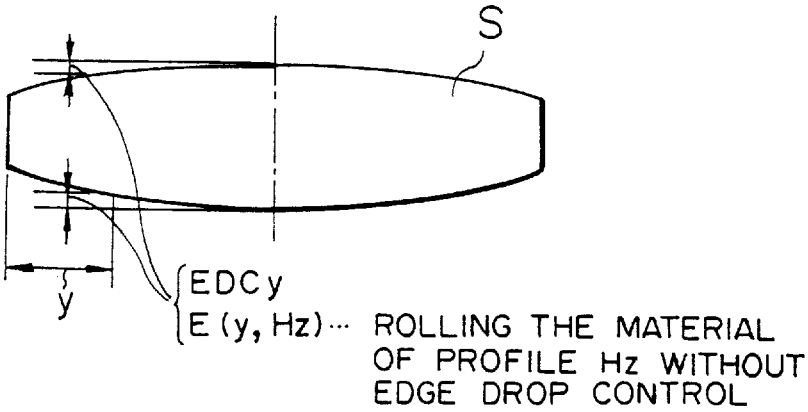
FIG. 29 is a sectional view illustrating the definition of edge drop on the exit side of a control stand.
Figure 30:
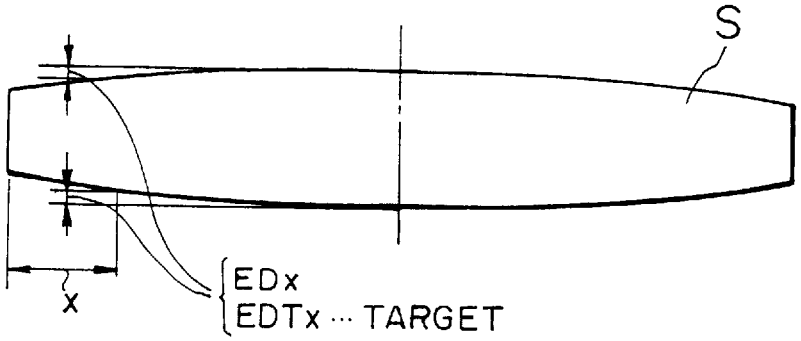
FIG. 30 is a sectional view illustrating the definition of edge drop on the exit side of a final stand.

The quantity of edge drop here is defined as follows. In the material strip, as shown in FIG. 28, the thickness deviation between the width center and a position of z mm from the sheet end is defined as the quantity of edge drop Hz for the position of z mm from the sheet end. On the exit side of the control stand, as shown in FIG. 29, the thickness deviation between the width center and a position of y mm from the sheet end is defined as the quantity of edge drop DCy at the position of y mm from the sheet end. Further, on the exit side of the tandem mill (final stand), as shown in FIG. 30, the thickness deviation between the width center and a position of x mm from the sheet end is defined as the quantity of edge drop EDx (target value: EDTx) for the position of x mm from the sheet end.

Figure 31:
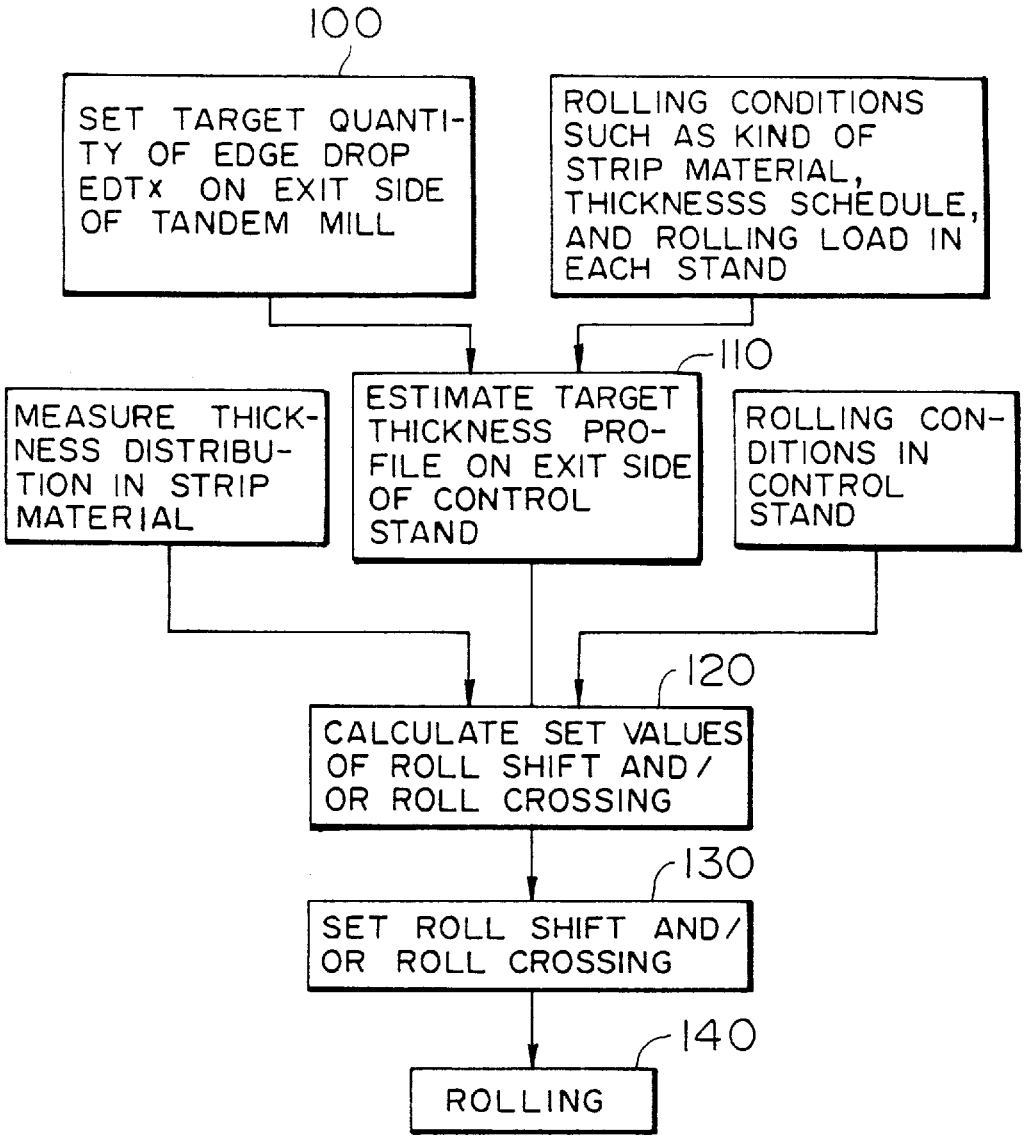
FIG. 31 is a flowchart illustrating the processing steps in the embodiment 5 of the invention.

Now, the steps for edge drop control in this embodiment will be described in detail with reference to FIG. 31.

First, a target quantity of edge drop EDTx on the exit side of the tandem mill is set (Step 100).

Then, a target thickness profile on the exit side of the control stand necessary for obtaining the foregoing target quantity of edge drop EDTx is estimated on the basis of the rolling conditions such as the rolling load for the individual stands (Step 110). In this estimation, a mathematical model simulating the behavior of an edge drop on the exit side of each stand is previously prepared through experiments, and it is possible to determine a target profile on the exit side of the control stand on the basis of this model formula by means of the kind of material strip, thickness schedule, rolling conditions such as rolling load for the individual stands, and the target quantity of edge drop EDTx.

Then, set values of roll shift and/or roll crossing necessary for obtaining a target thickness profile on the exit side of the control stand are calculated on the basis of the thickness distribution of the material strip measured at arbitrary point on the entry side of the mill and the rolling conditions at the control stand (Step 120). For these set values of roll shift and roll crossing also, mathematical models simulating the relationship between the roll shift and/or roll crossing and the thickness profile on the exit side of the control stand are previously prepared, and it is possible to calculate set values of roll shift or/and roll crossing necessary for obtaining a target thickness profile on the exit side of the control stand on the basis of these models with the thickness distribution of the material strip and under the rolling conditions at the control stand.

Then, roll shift or/and roll crossing are set on the thus calculated set quantities (Step 130), and rolling is thus carried out (Step 140).

In the invention, as described above, edge drops occurring in stands in the downstream of the edge drop control stand are taken into consideration, and it is possible to obtain a target edge drop accurately on the exit side of the final stand.

Example of Application of this Embodiment

Figure 32:
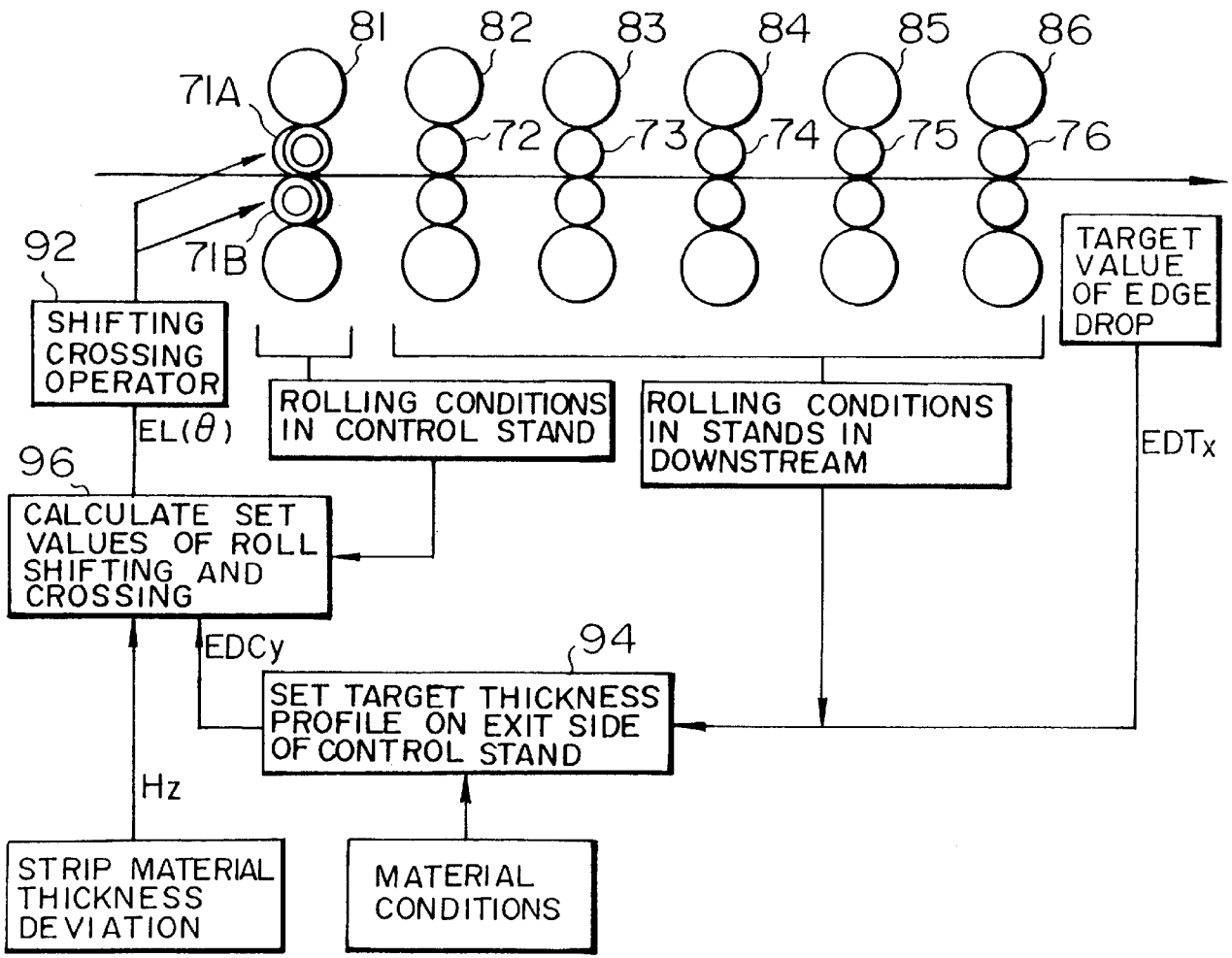
FIG. 32 is a block diagram illustrating the configuration of the embodiment 5 of the invention as applied to a six-stand tandem rolling mill having a first stand serving as the control stand.

FIG. 32 is a side view, including a block diagram, illustrating a schematic configuration of a six-stand cold rolling mill applied in the edge drop control method of this embodiment. The first stand serves as the control stand and is provided with a work roll crossing mechanism for causing crossing of a pair of upper and lower work rolls 71A and 71B and a work roll shifting mechanism for shifting these work rolls.

Figure 33:
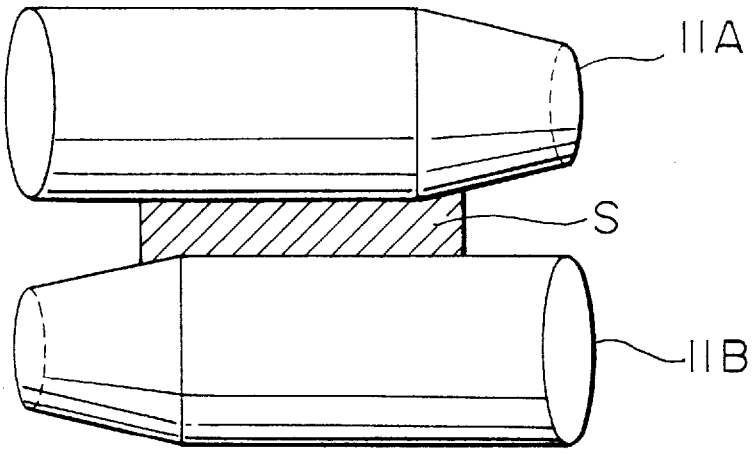
FIG. 33 is a side view illustrating the shape of work rolls used in a control stand.

The upper and lower work rolls 71A and 71B on the first stand serving as the control stand can conduct work roll shifting and work roll crossing under an instruction from a shift/crossing operator 92. Tapers 11A and 11B are provided, as shown in FIG. 33, at one side ends of the upper and the lower work rolls 71A and 71B. S is a material strip to be rolled.

The taper imparted to the work rolls 71A and 71B has such a shape that the roll diameter converges by 1 mm per 300 mm of roll barrel length (taper: 1/300). The thickness deviation in the width direction of the material strip before rolling is measured by a sensor installed on the exit side of the hot rolling mill, which is the preceding process, and is transmitted therefrom.

In FIG. 32, 72 to 76 are work rolls of Nos. 2 to 6 stands, and 81 to 86 are backup rolls of Nos. 1 to 6 stands. The reference numeral 94 is a target thickness profile setting unit on the exit side of the control stand, which sets a target thickness profile EDCy on the exit side of the control stand (first stand) on the basis of the rolling conditions of the Nos. 2 to 6 stands in the downstream, the target value of edge drop EDTx and material conditions (thickness profile, kind of steel and size). Also in FIG. 32, 96 is a roll shift/roll crossing set value calculating unit which calculates set values EL and θ of roll shift and roll crossing in response to the target profile EDCy on the exit side of the control stand as entered from the target profile setting unit 94 on the exit side of the control stand, rolling conditions of the control stand (first stand) and the material thickness deviation Hz.

Edge drop control was performed upon cold-rolling a steel sheet for tinplate pickled after hot rolling, in accordance with the rolling conditions shown in Table 2.

TABLE 2

| Stand No. | Entry side | 1 | 2 | 3 | 4 | 5 | 6 |
|---|---|---|---|---|---|---|---|
| Work roll diameter (mm) | | 560 | 540 | 550 | 570 | 610 | 610 |
| Exit side tension (kgf/mm$^2$) | * | 18 | 17 | 20 | 19 | 21 | 9 |
| Rolling load (tonf) | | 740 | 760 | 830 | 860 | 790 | 1000 |
| Exit side thickness (mm) | ** | 1.4 | 0.98 | 0.69 | 0.48 | 0.34 | 0.24 |

*: Entry side tension: 2 kgf/mm$^2$
**: Entry side thickness: 2.0 mm

The target quantity of edge drop EDTx on the exit side of the final (sixth) stand is a quantity of edge drop of 0 μm at a position of 10 mm from the sheet end, and this is expressed in the form of EDT10=0.

First, there is calculated a thickness deviation profile EDCy on the exit side of the control stand (first stand) necessary for obtaining a target quantity of edge drop EDT10 on the exit side of the final stand (sixth stand). The quantity of edge drop EDx on the exit side of the final stand is determined in response to the thickness deviation profile on the exit side of the control stand, the kind of the material to be rolled, the thickness schedule, and the rolling conditions including the rolling load for the individual stands.

In this embodiment, a model formula prepared as follows is employed. The model formula was prepared by discontinuing operation of the rolling mill in the middle of rolling, carrying out experiment (biting experiment) for sampling sample sheets from the exit side of the individual stands, measuring a thickness deviation for each sample, and investigating behavior of the edge drops on the exit side of each stand. The prepared model formula is to calculate a thickness deviation EDCy at a position of y mm from the sheet end (see FIG. 29) on the exit side of the control stand as the thickness profile, as shown in the following formula, from the deformation resistance S of the material strip, the quantity of edge drop EDx (see FIG. 30) on the exit side of the final stand (sixth stand), and the rolling conditions for the stands in the downstream of the control stand (first stand) including exit side thickness Hn for each stand in the downstream, the rolling load Pn, the exit side tension Tn, the work roll diameter WRn (where n is the stand No. in all cases):

$$EDCy=F\ (S, EDx, Hn, Pn, Tn, WRn) \tag{31}$$

In this embodiment, Nos. 2 to 6 stands are in the downstream of the control stand: stand no. n=2 to 6. Because the control position is at 10 mm from the sheet end, EDx=ED 10 (see FIG. 30), and in this case, the thickness deviations EDC 10 and EDC 30 (see FIG. 20) for the positions of y=10 mm from the sheet end and y=30 mm from the sheet end are employed as thickness profiles.

A target thickness profiles EDC 10 and EDC 30 at the control stand (first stand), necessary for obtaining a target value of edge drop EDT 10 on the exit side of the final stand (sixth stand) are calculated by means of the foregoing model formula (31).

Then, set quantities of roll shift and roll crossing necessary for obtaining target thickness profiles EDC 10 and EDC 30 of the first stand are calculated. For these set quantities of roll shift and roll crossing also, models of the relationship of roll shift and roll crossing with the thickness profile on the exit side of the control stand are previously prepared on the basis of results of the aforesaid biting experiments or experiments on a single-stand rolling mill.

In this embodiment, a quantity of shift EL and a crossing angle θ are determined in the following steps. First, a crossing angle θ giving a target profile EDC 30 on the strip center side from among target profiles is determined. That is, assuming rolling without performing edge drop control (the quantity of shift and the crossing angle are null), the crossing angle θ is changed to correct the thickness profile so as to eliminate the deviation between the thickness profile E (30, H25) on the exit side of the first stand with y=30 mm and z=25 mm and the target profile EDC 30. When the thickness profile of the material strip is Hz (see FIG. 28), for the determination of the thickness profile E (y, Hz) at a position of y mm from the strip end on the exit side of the first stand while rolling without performing edge drop control, the relationship between the thickness profile Hz of the material strip and the thickness profile at a position of y mm from the strip end on the exit side of the control stand should previously be determined through experiments. An improvement of the thickness profile by a change in crossing angle can be expressed by a product of the roll gap H (x, θ) resulting from crossing at the position of y mm from the strip end, as multiplied by the influence index (printing ratio) a. A model formula expressing this relationship is as follows:

$$EDC\ 30-E\ (30, H25)=a\cdot H\ (30, \theta) \tag{32}$$

After determining a crossing angle θ satisfying the formula (32), a quantity of shift EL giving a target profile EDC 10 (see FIG. 29) from among target profiles under the crossing angle θ is calculated. The thickness profile is improved by shifting so as to eliminate a deviation between the thickness profile C (10, H25, θ) at a position of 10 mm from the strip end on the exit side of the first stand and the target profile EDC 10, when rolling with a crossing angle θ with a thickness profile of H25 of the material strip. In this operation, C (y, Hz, θ) represents the thickness profile at a position of y mm from the strip end on the exit side of the first stand when rolling with a crossing angle θ with a thickness profile of the material strip of Hz.

Improvement of a thickness profile by shifting can be expressed by the relationship of a product of the roll gap G (x, EL) at a position of y mm from the strip end resulting from a quantity of shift EL alone, as multiplied by the influence index (printing ratio) b. This relationship is expressed by the following model formula:

$$EDC\ 10-C(10,H25,\theta)=b\cdot G(x,EL) \tag{33}$$

A quantity of shift EL satisfying this formula (33) is therefore calculated.

While, in the above description, a crossing angle θ is first determined, and then a quantity of shift EL is calculated, a crossing angle θ and a quantity of shift EL may be simultaneously determined by a technique comprising the steps of, in a model formula expressing the relationship of the crossing angle θ and the quantity of shift EL with the thickness profile on the exit side of the first stand, defining a deviation between a thickness profile and a target value as a control function, and optimizing this control function. The thickness profiles for two positions are determined in the above description, as the target thickness profile on the exit side of the first stand, whereas thickness profiles of more positions may be provided as targets.

Figure 34:
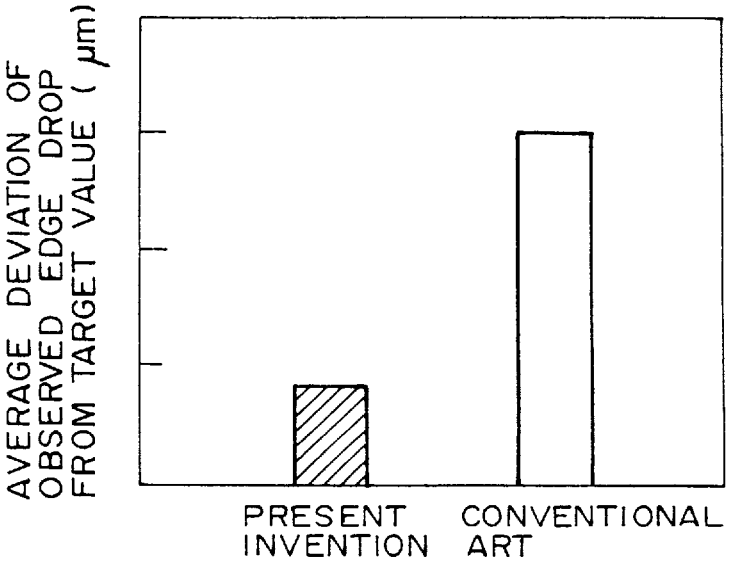
FIG. 34 is a graph comparing the effects between the embodiment 5 of the invention and the conventional method.

Each 20 coils were rolled by the edge drop control of this embodiment and by the conventional edge drop control not taking account of occurrence of edge drops in stands subsequent to the control stand, to compare deviations between a target edge drop and an observed edge drop. The result is shown in FIG. 34. As is clear from FIG. 34, the present invention makes it possible to achieve edge drop improvement far superior to that by the conventional method.

Embodiment 6

The following description of an embodiment of the invention will demonstrate that it is possible, in a method for continuously rolling a strip on a tandem mill comprising a plurality of stands, which comprises the steps of shift-controlling the work rolls each having a tapered end in the axial direction and cross-controlling the upper and the lower work rolls on at least two of the plurality of stands, to appropriately set a quantity of shift and a crossing angle and to improve an edge drop satisfactorily, by:

performing a work roll shift control and work roll crossing control on leading side stands from among the two or more stands to be subjected to the shift control and the crossing control, on the basis of a thickness distribution detected in the upstream of the leading side stands; and performing a work roll shift control and work roll cross control on leading side stands from among the two or more stands to be subjected to the shift control and the crossing control, on the basis of a thickness distribution detected in the downstream of the trailing side stands.

Now, the embodiment of the width direction thickness control method of the invention will be described below in detail with reference to the drawing, for an example of application to a six-stand cold-rolling tandem mill provided with one-side-tapered work rolls on the first and the final sixth stands, a roll shifting mechanism for shifting the work rolls and a roll crossing mechanism for causing the work rolls to cross each other.

Figure 35:
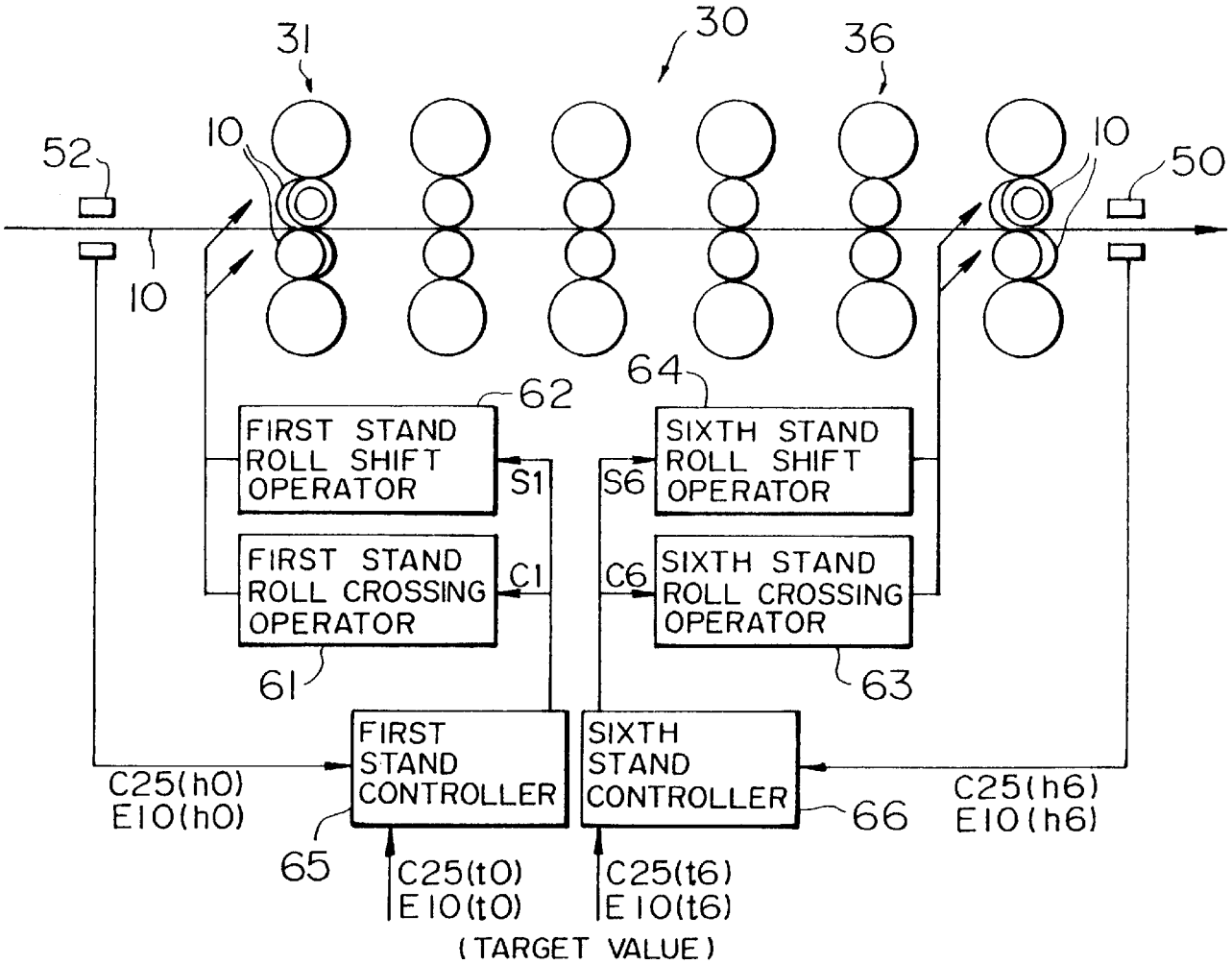
FIG. 35 is a block diagram illustrating the configuration of an embodiment 6 of the invention as applied to a six-stand tandem rolling mill.

FIG. 35 is a schematic view illustrating a six-stand cold-rolling tandem mill 30 for the application of the present invention.

A first stand 31 of this tandem rolling mill 30 is provided with one-side-tapered work rolls 10, a first stand roll crossing operator 61 for causing the work rolls 10 to cross each other, and a first stand roll shifting operator 62 for shifting the work rolls 10. The work rolls 10 can conduct work roll crossing under an instruction from the first stand roll crossing operator 61, and work roll shifting under an instruction from the first stand roll shifting operator 62.

A final sixth stand 36 is also provided with one-side-tapered work rolls 10, a sixth stand roll crossing operator 63 for causing the work rolls 10 to cross each other, and a roll shifting operator 64 for shifting the work rolls 10. The work rolls 10 can conduct work roll crossing under an instruction from the sixth stand roll crossing operator 63, and work roll shifting under an instruction from the sixth stand roll shifting operator 64.

In this embodiment, there are provided an entry-side (thickness) profile meter 52 for measuring the thickness distribution in the width direction of the material strip before rolling on the entry side of the first stand 31, and an exit-side (thickness) profile meter 50 for measuring the thickness distribution in the width direction of the rolled product on the exit side of the final sixth stand 36, carrying out measurement at a cycle of, for example, one second.

Now, a first control point of a width direction thickness deviation derived from an output of the entry-side and the exit-side profile meters 52 and 50 is set at a position of 25 mm from the strip end, and a second control point, at a position of 10 mm from the strip end, and measured values of thickness deviations at the first and the second control points of the material strip are defined as follows:

C 25 (h0): Measured value of thickness deviation between the width center and a position of 25 mm from the strip end (first control point) as measured by the entry-side profile meter 52;

E 10 (h0): Measured value of thickness deviation between positions of 25 mm and 10 mm (second control point) from the strip end as measured by the entry-side profile meter 52.

Target values of thickness deviations of the first and the second control points similarly in the material strip are defined as follows:

C 25 (t0): Target value of thickness deviation between the width and a position of 25 mm (first control point) from the strip end;

E 10 (t0): Target value of thickness deviation between positions of 25 mm and 10 mm (second control point) from the strip end.

Similarly, measured values of thickness deviation of the first and the second control points in the rolled product are defined as follows:

C 25 (h6): Measured value of thickness deviation between the width center and a position of 25 mm (first control point) from the strip end, as measured by the exit-side profile meter 50;

E 10 (h6): Measured value of thickness deviation between positions of 25 mm and 10 mm (second control point) from the strip end, as measured by the exit-side profile meter 50.

Similarly, target values of thickness deviation of the first and the second control points in the rolled product are defined as follows:

C 25 (t6): Target value of thickness deviation between the width center and a position of 25 mm (first control point) from the strip end;

E 10 (t6): Target value of thickness deviation between positions of 25 mm and 10 mm (second control point) from the strip end.

When there is a change in the measured values C 25 (h0) and E 10 (h0) measured by the foregoing entry-side profile meter 52 during rolling, the first stand controller 65 calculates quantities of operation of work roll shifting and work roll crossing of the first stand 31 in response to such a change. More specifically, for the measured value of thickness deviation C 25 (h0) of the first control point measured by the entry-side profile meter 52, a deviation ΔC 25 (h0) from the target value of thickness deviation C 25 (t0) of the first control point is calculated in accordance with the following formula:

$$\Delta C\ 25\ (h0)=C\ 25\ (h0)-C\ 25\ (t0) \tag{34}$$

Then, a quantity of correction of roll crossing of the work roll 10 of the first stand 32 is calculated in response to the thus determined deviation ΔC 25 (h0). Specifically, for example, the relationship between the deviation ΔC 25 (h0) and the quantity of necessary correction C1 of the crossing angle of the first stand corresponding to that deviation is previously determined as the influence index, and calculation can be performed by the following model formula:

$$C1=a\cdot\Delta C\ 25\ (h0) \tag{35}$$

Further, for the measured value of thickness deviation of E 10 (h0) the second control point as measured by the entry-side profile meter 52, the first stand controller 65 determines the deviation ΔE 10 (h0) from the target value of thickness deviation E 10 (t0) of the first control point in accordance with the following formula:

$$\Delta E\ 10\ (h0)=E\ 10\ (h0)-E\ 10\ (t0) \tag{36}$$

Then, in response to the thus determined deviation ΔE 10 (h0), a quantity of correction S1 of roll shifting of the work rolls 10 of the first stand 31 is calculated. In detail, for example, the relationship between the deviation ΔE 10 (h0) and the quantity of necessary correction of roll shifting is previously determined as the influence index b, S1 can be calculated by means of the following model formula:

$$S1=b\cdot\Delta E\ 10\ (h0) \tag{37}$$

The sixth stand controller 66 calculates, on the other hand, quantities of operation of work roll shifting and work roll crossing of the sixth stand 36 so as to achieve a target profile in the rolled product, i.e., so as to eliminate a deviation between a measured value of exit-side profile after the mill and the target profile. More specifically, for the measured value of thickness deviation C 25 (h6) of the first control point as measured by the exit-side profile meter 50, the deviation ΔC 25 (h6) from the target value of thickness deviation C 25 (t6) of the first control point is calculated by the following formula:

$$\Delta C\ 25\ (h6)=C25\ (h6)-C\ 25\ (t6) \tag{38}$$

Then, in response to the thus determined deviation ΔC 25 (h6), the quantity of correction of roll crossing of the work rolls of the first stand 31 is calculated. For example, it is calculable from the following model formula by previously determining the relationship between the deviation ΔC 25 (h6) and the quantity of necessary correction C6 of the crossing angle of the sixth stand as the influence index c:

$$C6=c\cdot\Delta C\ 25\ (h6) \tag{39}$$

Further, for the measured value of thickness deviation E 10 (h6) of the second control point as measured by the exit-side profile meter 50, the sixth stand controller 65 calculates the deviation ΔE 10 (h6) from the target value of thickness deviation E 10 (t6) of the first control point by the following formula:

$$\Delta E\ 10\ (h6)=E\ 10\ (h6)-E\ 10\ (t6) \tag{40}$$

Then, in response to the thus determined deviation ΔE 10 (h6), the quantity of correction S6 of roll shifting of the work rolls of the sixth stand 36 is calculated. Specifically, the relationship between the deviation ΔE 10 (h6) and the quantity of necessary correction S6 of roll shifting is previously determined as the influence index d, and S6 can be calculated by means of the following model formula:

$$S6=d\cdot\Delta E\ 10\ (h6) \tag{41}$$

The method for calculating the quantity of correction of the roll crossing angle or the quantity of roll shift is not limited to that based on the above model formulae, but a method of selecting a necessary quantity of correction by the use of a table prepared on the basis of actually measured values.

In the case of cold rolling, for example, the width direction thickness distribution in the material strip before rolling can be measured by means of a thickness profile meter on the entry side of the cold mill, on the exit side of the hot rolling mill, or between the hot and cold mills. It may be measured online.

Further, setting of the individual control points is not limited to the manner described in this embodiment, but the first control points may be set at a position of 100 mm from the strip end.

Example of Application of this Embodiment

The following paragraphs describe a case of application of this embodiment to a six-stand cold-rolling mill provided with one-side-tapered work rolls in the first and the sixth stands, a roll shifting mechanism shifting the work rolls and a roll crossing mechanism causing the work rolls to cross each other.

Figure 36:
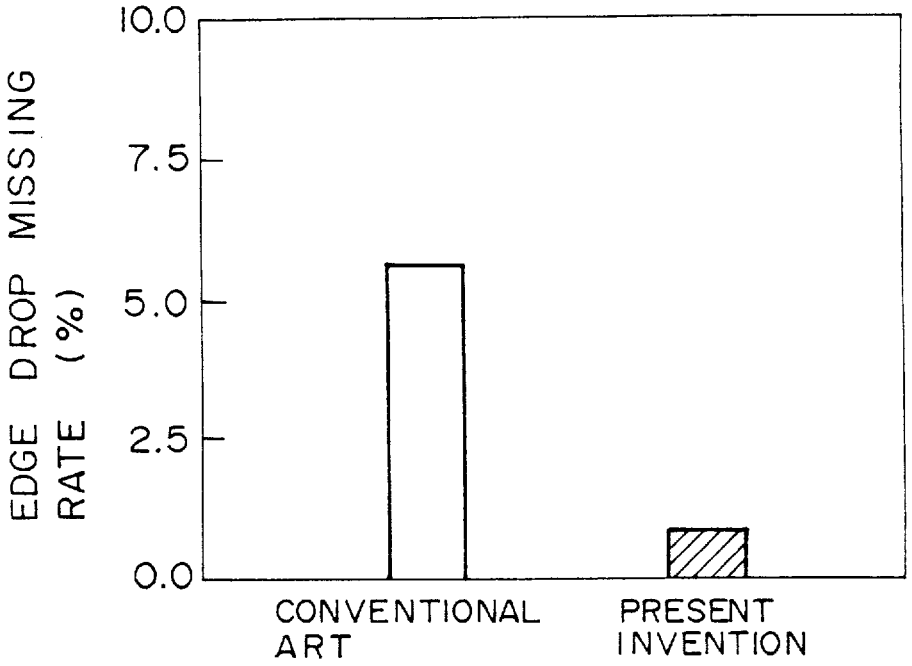
FIG. 36 is a graph comparing the average values of edge drop missing ratio between the conventional case and the embodiment 6 of the invention.

A steel sheet for tinplate, pickled after hot rolling, having a width of 900 mm, was rolled for 20 coils. Average values of the missing ratio (width direction thickness rejection ratio) representing the ratio of the thickness distribution at positions of 25 mm and 10 mm from the edge in the longitudinal direction of the steel sheet, coming off a prescribed control range are compared in FIG. 36 between a conventional case using work roll shifting alone and this embodiment of the invention. The taper had a shape having a radius reduced by 1 mm per 300 mm length in the barrel direction (taper: 1/300).

This permitted confirmation that the invention brings about a remarkable improvement of thickness distribution in the width direction far superior to that in the conventional method.

Several embodiments and concrete example of application have been presented above. The configurations of rolling facilities to which the present invention is applicable are not limited to those shown in these embodiment.

For example, the mill is not limited to four-high or six-high mill, but may be a two-high mill. The number of stands is not limited to 6 or 5 as shown in the embodiments, but invention is applicable even to a single-stand mill, and the number of stand is arbitrary.

The stand provided with shifting & crossing mechanisms of tapered work rolls is not limited to the first stand, but may be any of the stands, and is not limited to a single stand, but a plurality of stands may be used.

The work rolls may be pair-crossing ones in which work rolls cross each other in pair with backup rolls.

The material strip to be rolled is not limited to a steel sheet, but may be an aluminum sheet, a copper sheet or any other metal sheet.

The tapered work roll is not technically limited to one-side tapered roll. It suffices that at least an end of the roll is tapered.

Furthermore, the tapered roll may technically be any one of upper and lower work rolls: for example, even only upper tapered work roll or only lower tapered roll would display sufficient advantages.

What is claimed is:

1. A rolling method of a strip for reducing an edge drop, by causing a pair of work rolls, each having a tapered end, to shift in an axial direction, the pair of work rolls including an upper work roll and a lower work roll that cross each other, the method comprising the steps of:

(a) determining a quantity of shift and a crossing angle as quantities of operation necessary for correcting the edge drop of the strip; and (b) causing the work rolls to shift by the determined quantity of shift and causing the work rolls to cross each other at the determined crossing angle.

2. The rolling method of the strip according to claim 1, wherein said quantity of shift and said crossing angle are determined by the steps of:

(a) determining a target quantity of correction of the edge drop necessary for correcting the edge drop of the strip; and (b) determining the quantity of shift and the crossing angle necessary for correcting the edge drop of the strip based on a relationship of (1) the quantity of shift, (2) the crossing angle, and (3) the target quantity of correction of the edge drop relating to (1) and (2).

3. The rolling method of the strip according to claim 1, wherein the quantity of shift and the crossing angle are determined by the steps of:

(a) providing an effective roll gap reference position at a certain distance from an edge of the strip; determining a quantity of roll gap necessary for obtaining a desired quantity of correction of the edge drop based on a relationship between the quantity of roll gap between the upper and the lower work rolls relative to the reference position, and the desired quantity of correction of the edge drop; and (b) determining the quantity of shift and the crossing angle based on a relationship with the quantity of roll gap.

4. The rolling method of the strip according to claim 1, wherein the quantity of shift and the crossing angle are determined by the steps of:

(a) determining a target quantity of correction of the edge drop necessary for correcting the edge drop of the strip based on a previously determined relationship between the crossing angle and a relationship of the target quantity of correction of the edge drop with a quantity of change in roll gap; and (b) determining the quantity of shift and the crossing angle necessary for correcting the edge drop of the strip based on a relationship of the quantity of shift, a relationship of the target quantity of correction of the edge drop with the quantity of change in roll gap, a relationship of the target quantity of correction of the edge drop therewith, and a relationship of the crossing angle and a relationship of the target quantity of correction of the edge drop with the quantity of change in roll gap.

5. The rolling method of the strip according to claim 1, wherein the quantity of shift and the crossing angle are determined by the steps of:

(a) determining a target quantity of correction of the edge drop necessary for correcting the edge drop of the strip based on a previously determined relationship between the crossing angle and a ratio of the target quantity of correction of the edge drop to a quantity of change in roll gap; and (b) determining the quantity of shift and the crossing angle necessary for correcting the edge drop of the strip based on at least one of the quantity of shift, a ratio of the target quantity of correction of the edge drop to the quantity of change in roll gap, a relationship of the target quantity of correction of the edge drop therewith, and a relationship between the crossing angle and the ratio of the target quantity of correction of the edge drop to the quantity of change in roll gap.

6. The rolling method of the strip according to claim 1, wherein at least two points of control of a quantity of the edge drop of the strip are provided on one side in a width direction, and the quantity of the edge drop at the edge drop control points is controlled.

7. The rolling method of the strip according to claim 1, wherein the method further comprises the steps of:

(a) setting a first control point apart from a width center by a prescribed distance and a second control point apart from the first control point by a prescribed distance toward a sheet edge side as control points of thickness distribution in the width direction of the strip;

(b) calculating a first thickness deviation at the first control point from a thickness at the width center and a second thickness deviation at the second control point from the thickness at said first control point, from a detected thickness distribution in the width direction of the strip;

(c) controlling the crossing angle based on the thickness deviation at the first control point from the thickness at the width center, and controlling the quantity of shift based on the thickness deviation at the second control point from the thickness at the first control point.

8. The rolling method of the strip according to claim 1, wherein a quantity of correction of the edge drop necessary for correcting the edge drop is calculated based on a thickness distribution of the strip measured before the quantity of shift and the crossing angle are controlled.

9. The rolling method of the strip according to claim 1, wherein a quantity of correction of the edge drop necessary for correcting the edge drop is calculated based on a thickness distribution of the strip measured after the quantity of shift and the crossing angle are controlled.

10. The rolling method of the strip according to claim 1, wherein a quantity of correction of the edge drop necessary for correcting the edge drop is calculated based on a thickness distribution of the strip measured before the quantity of shift and the crossing angle are controlled, and based on a thickness distribution of the strip measured after the quantity of shift and the crossing angle are controlled.

11. A rolling method of a strip for continuously rolling the strip on a tandem mill that includes a plurality of stands, each stand having work rolls including an upper work roll and a lower work roll, the method comprising the steps of:

(a) providing a mechanism for shifting the work rolls with each work roll having a tapered end and a mechanism for crossing the upper work roll and the lower work roll on at least one stand upstream of a final stand to cause the same to serve as a control stand;

(b) determining a quantity of shift and a crossing angle as quantities of operation necessary for correcting the edge drop of the strip; and (c) causing the work rolls to shift and cross each other with the determined quantity of shift and crossing angle.

12. The rolling method of a strip according to claim 11, wherein the method further comprises the steps of:

(a) setting a target value of a thickness distribution in a width direction on an exit side of the tandem mill;

(b) predicting the thickness distribution in the width direction on the exit side of the control stand relative to the set target value;

(c) using the predicted thickness distribution as a target thickness distribution on the exit side of the control stand; and (d) causing the work rolls to shift and cross each other on the control stand.

13. A rolling method of a strip for continuously rolling the strip on a tandem mill comprising a plurality of stands, each stand having work rolls including an upper work roll and a lower work roll, the method comprising the steps of:

(a) shift controlling the work rolls, with each work roll having a tapered end, in an axial direction and cross controlling the upper and the lower work rolls on at least two of the plurality of stands;

(b) performing a work roll shift control and a work roll cross control on leading side stands from among the plurality of stands based on a first thickness distribution detected upstream of the leading side stands; and (c) performing the work roll shift control and the work roll cross control on the leading side stands from among the plurality of stands based on a second thickness distribution detected downstream of trailing side stands.

14. A control apparatus for a rolling mill for a strip, the rolling mill including at least one of a pair of work rolls, with each work roll having a tapered end and provided with a shifting mechanism which causes the tapered rolls to shift in an axial direction and a crossing mechanism which causes the rolls to rotate by a certain angle within a plane parallel to a rolling plane to achieve mutual crossing, the control apparatus comprising:

(a) means for determining a quantity of shift and a crossing angle for correcting the edge drop of the strip; and (b) means for sending the determined quantity of shift and crossing angle to the shifting mechanism and the crossing mechanism to cause the work rolls to shift by the quantity of shift and to cross the work rolls by the crossing angle.

15. The control apparatus according to claim 14, further comprising:

(a) means for calculating a target quantity of correction of the edge drop necessary for correcting a quantity of the edge drop; and (b) means for determining the quantity of shift and the crossing angle necessary for correcting the quantity of the edge drop of the strip based on a relation of (1) the quantity of shift, (2) the crossing angle, and (3) the target quantity of correction of the edge drop relating to (1) and (2).

16. The control apparatus according to claim 14, further comprising means for establishing a reference position apart from a sheet edge by a certain distance; means for calculating a quantity of roll gap necessary for achieving a desired improvement of the edge drop based on a relationship between a roll gap between the upper and the lower work rolls with at least one of the reference positions as a reference and the quantity of correction of the edge drop.

17. The control apparatus according to claim 14, further comprising:

(a) means for determining a target quantity of correction of the edge drop necessary for correcting the quantity of the edge drop of the strip based on a previously determined relationship between the crossing angle and a relationship of the target quantity of correction of the edge drop with a quantity of change in roll gap; and (b) means for determining the quantity of shift and the crossing angle necessary for correcting the edge drop of the strip based on at least one of a relationship of the quantity of shift, a relationship of the target quantity of correction of the edge drop with the quantity of change in roll gap, a relationship of the target quantity of correction of the edge drop therewith, a relationship of the crossing angle and a relationship of the target quantity of correction of the edge drop with the quantity of change in roll gap.

18. The control apparatus according to claim 14, wherein at least two points for controlling a quantity of the edge drop are provided on one side in a width direction, and an improvement of the edge drop is achieved at the edge drop control points.

19. The control apparatus according to claim 14, further comprises measuring means for measuring a thickness profile for calculating a quantity of correction of the edge drop necessary for correcting the edge drop is set on an exit side of the rolling mill.

20. A tandem rolling mill including a plurality of stands, wherein at least one stand except for a final one is a control stand, each stand having a pair of work rolls with each work roll having a tapered end, the tandem rolling mill comprising:

(a) a shifting mechanism which causes the pair of work rolls from at least one stand to shift in an axial direction, and a crossing mechanism which causes the rolls to cross each other in a horizontal plane; and (b) control means which determines a quantity of shift and a crossing angle as quantities of operation necessary for correcting the edge drop of the strip, and (c) means for sending the determined quantity of shift and crossing angle to the shifting mechanism and the crossing mechanism to cause the work rolls to shift by the quantity of shift and to cause the work rolls to cross each other at the crossing angle.

21. The tandem rolling mill according to claim 20, wherein, the control stand located closest to an exit side of the tandem rolling mill causes the work rolls to shift and cross each other, the control stand including:

means for setting a target value of thickness distribution in a width direction on an exit side of the tandem rolling mill; means for predicting a thickness distribution in a width direction on an exit side of the control stand relative to the set target value; and means for using the predicted thickness distribution as a target thickness distribution on the exit side of the control stand.

22. A control apparatus for a tandem rolling mill adapted for permitting a thickness control in a width direction of a strip, the tandem rolling mill including a plurality of stands with at least one stand having a shifting mechanism for causing a pair of work rolls with each work roll having a tapered end to shift in an axial direction and a crossing mechanism for causing the work rolls to cross each other within a horizontal plane, the control apparatus comprising:

(a) means for determining a quantity of shift and a crossing angle as quantities of operation necessary for correcting an edge drop of the strip;

(b) means for sending the determined quantity of shift and crossing angle to the shifting mechanism and the crossing mechanism, respectively, to cause the work rolls to shift by the quantity of shift and to cross each other by the crossing angle;

(c) means for detecting a first thickness distribution in a width direction before rolling;

(d) means for detecting a second thickness distribution in the width direction after rolling;

(e) means for crossing/shifting control of the rolls of leading side stands based on a first thickness profile derived from the first thickness distribution detected before rolling; and (f) means for crossing/shifting control of the rolls of trailing side stands based on a second thickness profile derived from the second thickness distribution detected after rolling.

23. The control apparatus according to claim 20, further comprising:

(a) thickness distribution detecting means in the width direction arranged downstream of the tandem rolling mill, upstream of the tandem rolling mill, and immediate downstream of the stand having the shifting mechanism and the crossing mechanism; and (b) means for controlling the quantity of shift and the crossing angle based on results of detection by at least one of the first and second thickness distribution detecting means in the width direction.

* * * * *